US011789386B2

(12) United States Patent
Yumoto et al.

(10) Patent No.: US 11,789,386 B2
(45) Date of Patent: Oct. 17, 2023

(54) RECORDING DEVICE AND TRANSPORT DEVICE

(71) Applicant: SEIKO EPSON CORPORATION, Tokyo (JP)

(72) Inventors: Yuya Yumoto, Shiojiri (JP); Junpei Yamashita, Azumino (JP); Osamu Murayama, Higashichikuma-Gun (JP); Shinya Yamazaki, Higashichikuma-Gun Asahi-Mura (JP); Nobuaki Kamiyama, Matsumoto (JP); Shigenori Nakagawa, Tatsuno-Machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/820,523

(22) Filed: Aug. 17, 2022

(65) Prior Publication Data

US 2023/0053888 A1 Feb. 23, 2023

(30) Foreign Application Priority Data

Aug. 20, 2021 (JP) ..... 2021-134650

(51) Int. Cl.
*G03G 15/16* (2006.01)
*G03G 15/01* (2006.01)
(Continued)

(52) U.S. Cl.
CPC ..... *G03G 15/168* (2013.01); *G03G 15/0189* (2013.01); *G03G 15/161* (2013.01);
(Continued)

(58) Field of Classification Search
CPC ..... G03G 15/0189; G03G 15/161; G03G 15/166; G03G 15/168; G03G 21/06;
(Continued)

(56) References Cited

U.S. PATENT DOCUMENTS

2002/0159801 A1* 10/2002 Nakashima ..... G03G 15/162 399/249
2014/0253622 A1 9/2014 Momose
(Continued)

FOREIGN PATENT DOCUMENTS

EP 3115218 1/2017
JP 6295980 3/2018
(Continued)

*Primary Examiner* — Joseph S Wong
(74) *Attorney, Agent, or Firm* — WORKMAN NYDEGGER

(57) ABSTRACT

A recording device includes a recording unit configured to perform recording on a medium, a transporting belt configured to transport the medium, the transporting belt including a surface on which the medium is able to be supported, a washing unit configured to wash the surface using a liquid, an ultrasonic sensor configured to transmit an ultrasonic wave onto the surface and receive the ultrasonic wave reflected from the surface, and a control unit configured to determine a remaining state of the liquid on the surface based on a result of detection by the ultrasonic sensor, in which the ultrasonic sensor transmits the ultrasonic wave onto at least part of the transporting belt, from downstream of the washing unit to upstream of the recording unit, in a rotation direction of the transporting belt.

7 Claims, 11 Drawing Sheets

(51) Int. Cl.
*G03G 21/16* (2006.01)
*G03G 21/06* (2006.01)

(52) U.S. Cl.
CPC ..... *G03G 15/166* (2013.01); *G03G 21/06* (2013.01); *G03G 21/1695* (2013.01); *G03G 2215/00637* (2013.01); *G03G 2215/00666* (2013.01); *G03G 2215/00776* (2013.01)

(58) Field of Classification Search
CPC ..... G03G 21/1695; G03G 2215/00637; G03G 2215/00666; G03G 2215/00776
See application file for complete search history.

(56) References Cited

U.S. PATENT DOCUMENTS

2017/0364012 A1* 12/2017 Okumura ..... G03G 15/5029
2019/0265615 A1* 8/2019 Okumura ..... G03G 15/16

FOREIGN PATENT DOCUMENTS

JP 2020-063133 A 4/2020
WO 2012/073907 5/2014

* cited by examiner

RECORDING DEVICE AND TRANSPORT DEVICE

The present application is based on, and claims priority from JP Application Serial Number 2021-134650, filed Aug. 20, 2021, the disclosure of which is hereby incorporated by reference herein in its entirety.

BACKGROUND

1. Technical Field

The present disclosure relates to a recording device and a transport device.

2. Related Art

JP-A-2020-63133 discloses a known device including a detection unit employing an electrical resistance method, an electrostatic capacitance method, an infrared method, a microwave method, or the like, to detect a remaining state of a washing solution remaining on a surface of a transporting belt that transports a recording medium.

Unfortunately, the detection unit, in the device described in JP-A-2020-63133, for the washing solution remaining on the surface of the transporting belt is not simple, and involves a risk of accuracy deterioration.

SUMMARY

A recording device includes a recording unit configured to perform recording on a medium, a transporting belt configured to transport the medium, the transporting belt including a surface on which the medium is able to be supported, a washing unit configured to wash the surface using a liquid, an ultrasonic sensor configured to transmit an ultrasonic wave onto the surface and receive the ultrasonic wave reflected from the surface, and a control unit configured to determine a remaining state of the liquid on the surface based on a result of detection by the ultrasonic sensor, in which the ultrasonic sensor transmits the ultrasonic wave onto at least part of the transporting belt, from downstream of the washing unit to upstream of the recording unit, in a rotation direction of the transporting belt.

A transport device includes a transporting belt configured to transport a medium, a pressing unit configured to press the medium onto a surface of the transporting belt, a washing unit configured to wash the surface using a liquid, and an ultrasonic sensor including a transmission unit configured to transmit an ultrasonic wave onto the surface and a reception unit configured to receive the ultrasonic wave reflected from the surface, in which the ultrasonic sensor transmits the ultrasonic wave onto at least part of the transporting belt, from downstream of the washing unit to upstream of the pressing unit, in a rotation direction of the transporting belt.

DESCRIPTION OF EXEMPLARY EMBODIMENTS

Embodiments will be described below with reference to the accompanying figures. Directions in the figures are described using a three-dimensional coordinate system with an X axis, a Y axis, and a Z axis orthogonal to each other. A direction along the X axis is referred to as an "X direction", a direction along the Y axis is referred to as a "Y direction", and a direction along the Z axis is referred to as a "Z direction". For convenience of explanation, the positive direction of the Z direction is referred to as an upward direction or simply upward, the negative direction of the Z direction is referred to as a downward direction or simply downward. The positive direction of the X direction is referred to as a rightward direction or simply right, and the negative direction of the X direction is referred to as a leftward direction or simply left. The positive direction of the Y direction is referred to as a forward direction or simply forward, and the negative direction of the Y direction is referred to as a backward direction or simply backward.

1. Configuration of Recording Device

Figure 1:
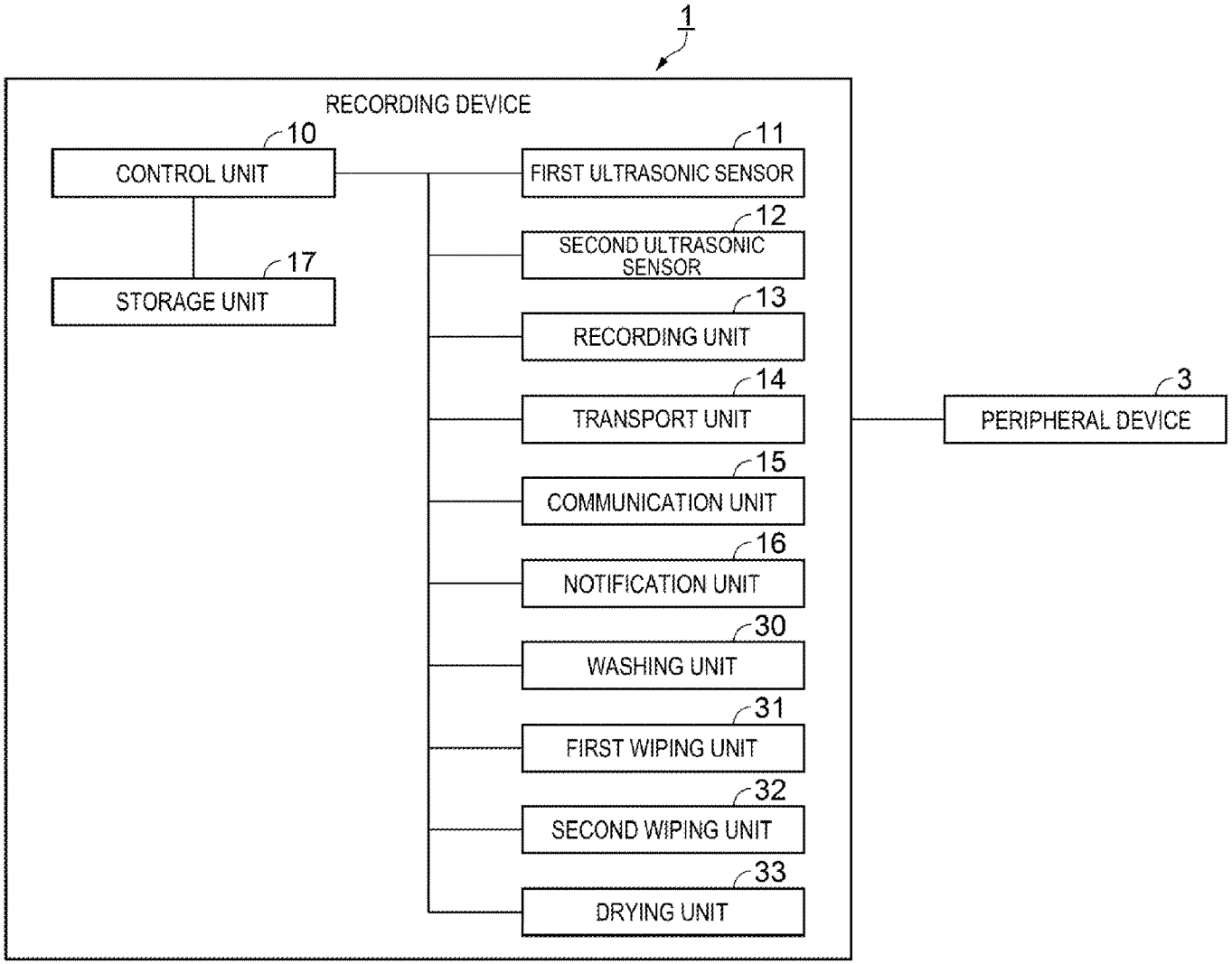
FIG. 1 is a block diagram illustrating a configuration of a recording device according to an embodiment.

As illustrated in FIG. 1, a recording device 1 includes a control unit 10, a storage unit 17, a first ultrasonic sensor 11, a second ultrasonic sensor 12, a recording unit 13, a transport unit 14, a communication unit 15, a notification unit 16, a washing unit 30, a first wiping unit 31, a second wiping unit 32, and a drying unit 33.

Note that in each of the embodiments described below, the first ultrasonic sensor 11, the second ultrasonic sensor 12, the first wiping unit 31, the second wiping unit 32, the drying unit 33, and the like illustrated in FIG. 1 are selected and configured. Description is given also with reference to the drawings illustrating the embodiments.

1-1. Configuration of Recording Device According to First Embodiment

The control unit 10 illustrated in FIG. 1 includes a central processing unit (CPU) that performs overall control on the units of the recording device 1, a universal asynchronous receiver transmitter (UART) that manages input and output, a field programmable gate array (FPGA) that is a logic circuit, a programmable logic device (PLD), and the like. The CPU is also simply referred to as a processor.

The storage unit 17 includes a rewritable non-volatile memory such as a flash read only memory (ROM) and a hard disk drive (HDD), a volatile memory such as a random access memory (RAM), and the like.

The CPU of the control unit 10 reads a program such as firmware stored in the non-volatile memory of the storage unit 17, and executes the program using the RAM in the storage unit 17 as a work area.

Figure 2:
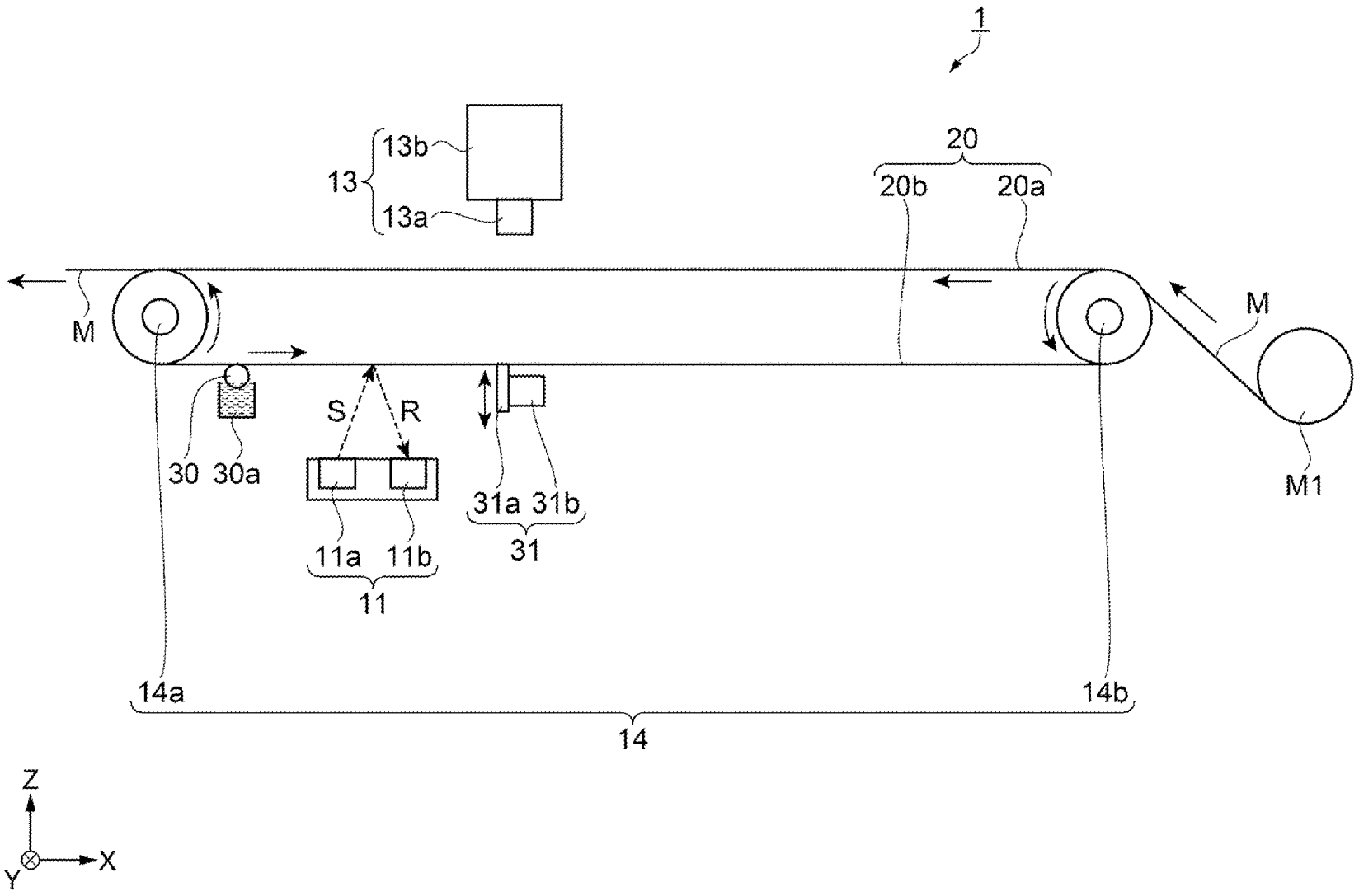
FIG. 2 is a schematic view illustrating a configuration of a recording device according to a first embodiment.

FIG. 2 illustrates the recording device 1 according to the first embodiment. A medium M illustrated in FIG. 2 is, for example, a cloth of an elongated form made of natural fibers or synthetic fibers. The cloth of an elongated form is also referred to as a raw fabric. The recording device 1 performs recording on the medium M. The recording on the cloth is also referred to as printing, and the medium M is also referred to as a printing material. Note that the medium M may be plain paper, synthetic paper, a film, or the like.

As illustrated in FIG. 2, the transport unit 14 includes a transporting belt 20 of an endless shape, a driving roller 14*a*, and a driven roller 14*b*. The transport unit 14 uses a transport motor (not illustrated) to cause counterclockwise rotation of the driving roller 14*a*, followed by counterclockwise rotation of the driven roller 14*b*. The transporting belt 20, supported on the driving roller 14*a* and the driven roller 14*b*, also rotates in the counterclockwise direction that is a rotation direction. The driving-driven relationship between the driving roller 14*a* and the driven roller 14*b* may be the other way around.

Note that, as illustrated in FIG. 2, assuming that the driving roller 14*a* of the transport unit 14 serves as the starting point, the washing unit 30, the first ultrasonic sensor 11, the first wiping unit 31, and the recording unit 13 are arranged in this order from the upstream to the downstream in the rotation direction of the transporting belt 20. The order opposite to this order is the order from the downstream to the upstream in the rotation direction of the transporting belt 20.

In the rotation direction of the transporting belt 20, a direction of moving from the driven roller 14*b* toward the driving roller 14*a* with the medium M placed is referred to as a forward direction, and a direction of moving from the driving roller 14*a* toward the driven roller 14*b* with the medium M peeled off is referred to as a backward direction.

As described below, the surface of the transporting belt 20 is provided with glue which is an adhesive, so that the medium M can be adhered thereon. The glue includes, for example, a silicone resin.

As illustrated in FIG. 2, a surface of the transporting belt 20 moving in the forward direction of the transporting belt 20 is referred to as a forward belt surface 20*a*, and a surface of the transporting belt 20 moving in the backward direction of the transporting belt 20 is referred to as a backward belt surface 20*b*. The forward belt surface 20*a* is a surface of the transporting belt 20 on which the medium M can be supported.

The transporting belt 20 enables the medium M to be adhered and fixed thereon by means of glue, to be stably transportable. The medium M after the recording can be easily peeled off from the transporting belt 20.

The medium M pulled out from a roll body Ml rolled into a roll form is placed on the forward belt surface 20*a* of the transport unit 14 to be transported toward the recording unit 13, under the control by the control unit 10. Note that the transport unit 14 may include a feeding device that pulls outs the medium M from the roll body Ml at a position close to the driven roller 14*b*, a winding device that winds the medium M peeled off from the forward belt surface 20*a* at a position close to the driving roller 14*a*, and the like.

As illustrated in FIG. 2, the recording unit 13 includes an ink-jet type head 13*a* and a carriage 13*b*. The carriage 13*b* includes a carriage motor. In the recording device 1, ink cartridges or ink tanks storing ink of respective colors, for example, cyan, magenta, yellow, and black (CMYK) that are ink colors, can be installed.

The recording unit 13 includes a supply mechanism for supplying ink to the head 13*a* from the ink cartridges and the like. The supply mechanism supplies ink of each color, from the ink cartridges and the like, to a corresponding nozzle of the head 13*a*.

The head 13*a* is installed in the carriage 13*b*, and moved back and forth in a front-rear direction by the carriage motor, together with the carriage 13*b*, over the medium M. The head 13*a* can perform recording on the medium M, by ejecting ink from the nozzle while moving over the medium M, under the control by the control unit 10 based on recording data.

The ink colors may be formed in any combination of four or more colors, that is, dark and light colors of CMYK and the like may be included, for example.

Furthermore, the head 13*a* may include a nozzle that ejects a penetrant onto the medium M. The penetrant is a liquid facilitating penetration of ink, attached on a surface of the medium M, to the opposite surface.

The washing unit 30 is provided downstream of the recording unit 13 and downstream of a position where the transporting belt 20 is in contact with the driving roller 14*a*, in the rotation direction of the transporting belt 20. The washing unit 30 can remove ink, foreign matters, and the like attached on the backward belt surface 20*b* of the transport unit 14 from which the medium M has been peeled off after the end of the recording by the recording unit 13.

The washing unit 30 includes a washing brush, and a brush rotating motor (not illustrated) that rotates the washing brush. The washing unit 30 can perform washing under the control by the control unit 10, with the washing brush, rotated by the brush rotating motor, brought into contact with the backward belt surface 20*b* while a washing solution that is a supplied liquid such as water is being sprayed.

In a washing container 30*a*, the washing solution is stored, and is discharged therefrom to maintain a constant solution level. The washing brush of the washing unit 30 is immersed at a certain depth in the washing solution stored in the washing container 30*a*, for removing ink, foreign matters, and the like attached thereto during the washing.

The washing brush may be a rotating brush, may be cloth, sponge, or brush of a cylindrical shape, rubber or resin in a plate shape, or the like.

As illustrated in FIG. 2, the first ultrasonic sensor 11 includes a first transmission unit 11*a* that is a transmitter that transmits a transmission wave S, and a first reception unit 11*b* that is a receiver that receives a reception wave R. The first ultrasonic sensor 11 uses, for example, an ultrasonic wave of 30 kHz to 10 MHz. The transmission wave S transmitted from the first transmission unit 11*a* toward the backward belt surface 20*b* is reflected on the backward belt surface 20*b* to be the reception wave R that is receivable by the first reception unit 11*b*.

The first ultrasonic sensor 11 can enable contactless detection of a distance to the backward belt surface 20*b*, based on time between the transmission of the transmission wave S from the first transmission unit 11*a* and the reception of the reception wave R by the first reception unit 11*b*. The control unit 10 can determine the state of the backward belt surface 20*b* easily and accurately, based on the result of the detection by the first ultrasonic sensor 11 varying depending on the state of the backward belt surface 20*b*.

Specifically, the first ultrasonic sensor 11 can detect that the time until the first reception unit 11*b* receives the reception wave R, which is the transmission wave S transmitted from the first transmission unit 11*a* onto the backward belt surface 20*b* and returning after being reflected on the washing solution, the foreign matter, or the like remaining on the backward belt surface 20*b*, is shorter than that when no washing solution, foreign matter, or the like remains on the backward belt surface 20*b*, and thus the distance is short.

The control unit 10 can determine the state of the backward belt surface 20*b*, such as remaining of the washing solution or the foreign matter, based on the distance, detected by the first ultrasonic sensor 11, varying.

Now, the first ultrasonic sensor 11 of the first embodiment will be described through comparison with other detection methods.

For example, when detectors employing an electrical resistance method or an electrostatic capacitance method are used for detecting a washing solution, a foreign matter, or the like remaining on the backward belt surface 20*b*, an electrode needs to be brought into contact with the washing solution, the foreign matter, or the like. It is difficult to properly bring the electrodes of such detectors in contact with the washing solution, the foreign matter, or the like remaining at a random location on the backward belt surface 20*b*.

On top of that, with such detectors, accurate detection may not be possible, because the impurities such as ink, foreign matters, or the like included in the washing solution cause variation in the electrical resistance or the electrostatic capacitance. Furthermore, when the electrodes of such detectors are contaminated with impurities, foreign matters, or the like, detection may fail to be performed accurately. A user has to perform maintenance such as removing impurities, foreign matters, and the like on the electrodes of the detectors.

For example, when a detector employing an infrared method is used, parts such as that shielding ambient light are required, because such a detector is also susceptible to the ambient light. Furthermore, with such a detector, when the washing solution remaining on the backward belt surface 20*b* includes impurities, foreign matters, or the like, the infrared light is absorbed or shielded by the impurities, foreign matters, or the like, and thus is difficult to penetrate. The ink included in the washing solution imposes a particularly large impact. On the other hand, when the washing solution remaining on the backward belt surface 20*b* does not includes much impurities, foreign matters, or the like, it is easy for the infrared light to penetrate. As described above, such a detector is affected by impurities, foreign matters, or the like in the washing solution, and thus may fail to achieve accurate detection.

For example, when a detector employing a microwave method is used, parts such as that shielding microwaves, which are electromagnetic waves, are required to prevent the microwaves from leaking out. Furthermore, such a detector requires an internal circuit and the like to be provided with countermeasures for noise, so as not to be affected by the electromagnetic waves. Furthermore, the microwaves may heat water included in the washing solution or the foreign matters to cause modification, which may result in failure to achieve accurate detection.

In the embodiments including the first embodiment, at least one of the first ultrasonic sensor 11 or the second ultrasonic sensor 12 is used, and thus an ultrasonic wave enabling contactless detection is used, so that the risks of the detectors employing the other methods described above can be avoided or reduced, whereby the state of the backward belt surface 20*b* such as the remaining of the washing solution, the foreign matters, or the like can be more easily and more accurately detected.

The first ultrasonic sensor 11 is configured to perform the detection by transmitting and receiving ultrasonic waves onto a detection target region that is at least part of the backward belt surface 20*b*, from the downstream of the washing unit 30 to the upstream of the recording unit 13 in the rotation direction of the transporting belt 20. In other words, the first ultrasonic sensor 11 is disposed the downstream of the washing unit 30 and the upstream of the recording unit 13 in the rotation direction of the transporting belt 20. As illustrated in FIG. 2, when the first wiping unit 31 is provided downstream of the first ultrasonic sensor 11, the first ultrasonic sensor 11 can perform detection on at least part of a region, in the backward belt surface 20*b*, from the downstream of the washing unit 30 to the upstream of the first wiping unit 31.

The first ultrasonic sensor 11 detects the distance to the backward belt surface 20*b* washed by the washing unit 30 in the detection target region. The control unit 10 can determine the state of the backward belt surface 20*b*, such as a state of the remaining of the washing solution or foreign matters on the backward belt surface 20*b* for example, based on the result of the detection by the first ultrasonic sensor 11.

The detection distance and sensitivity of the first ultrasonic sensor 11 can be adjusted by means of the output power of the first transmission unit 11*a* for outputting the transmission wave S and the like.

As described above, the first ultrasonic sensor 11 is configured to enable contactless detection on the backward belt surface 20*b*, with the detection distance being adjustable. Thus, the first ultrasonic sensor 11 may be at any position to be able to transmit and receive an ultrasonic wave to and from the detection target region of the transporting belt 20, which need not be the position illustrated in FIG. 2. For example, the first ultrasonic sensor 11 may be disposed upstream of the washing unit 30, or may be disposed downstream of the first wiping unit 31.

Figure 3:
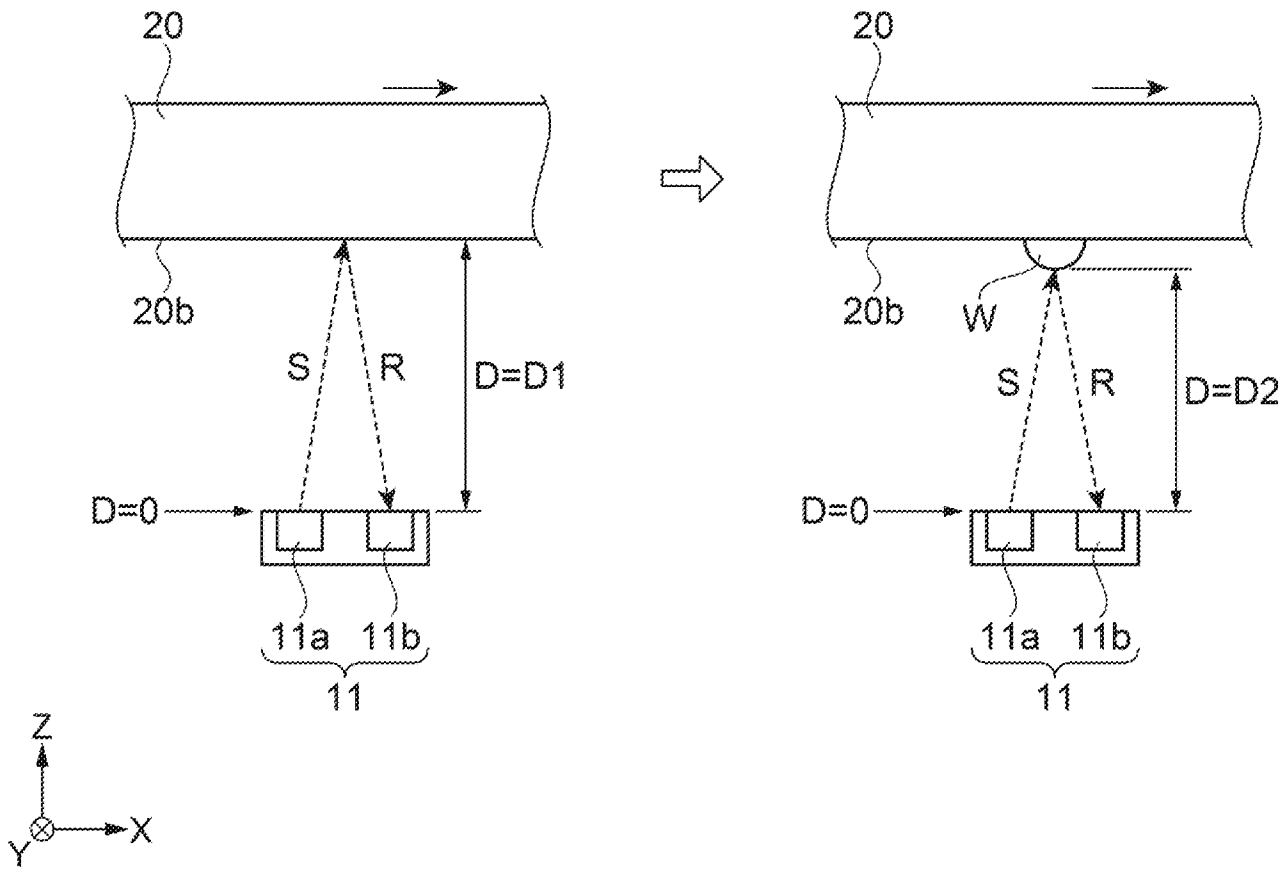
FIG. 3 is a diagram illustrating an example of detection of a washing solution or a foreign matter by an ultrasonic sensor.

Referring now to FIG. 3, an example is described in which the control unit 10 determines the state of the backward belt surface 20*b*, based on the result of the detection by the first ultrasonic sensor 11.

The first ultrasonic sensor 11 can detect a distance D to the backward belt surface 20*b* that is the detection target, based on speed of the ultrasonic wave used and time until the reception wave R is received after the transmission of the transmission wave S.

Note that the control unit 10 may control the first ultrasonic sensor 11 to transmit the transmission wave S and receive the reception wave R, acquire the time between the transmission and the reception, and calculate the distance D to the backward belt surface 20*b* based on the speed of the ultrasonic wave.

FIG. 3 illustrates two different states of the backward belt surface 20*b*. As illustrated in FIG. 3, in the first ultrasonic sensor 11, the first transmission unit 11*a* transmits the transmission wave S onto the backward belt surface 20*b*, and the first reception unit 11*b* receives the reception wave R, which is the transmission wave S reflected.

The distance D detected by the first ultrasonic sensor 11 is a distance to the backward belt surface 20*b* that is the detection target from the position of the first ultrasonic sensor 11 on the Z axis in the coordinate system illustrated in FIG. 3. Note that the position of the first ultrasonic sensor 11 is defined as (distance D=0).

A left mode in FIG. 3 illustrates a state that no washing solution, foreign matter, or the like remains on the backward belt surface 20*b*. In the state that no washing solution, foreign matter, or the like remains on the backward belt surface 20*b*, in the first ultrasonic sensor 11, the first transmission unit 11*a* transmits the transmission wave S toward the backward belt surface 20*b*, and the first reception unit 11*b* receives the reception wave R as a result of the transmission wave S directly reflected on the backward belt surface 20*b*.

When no droplet W of washing solution remains on the backward belt surface 20*b*, the first ultrasonic sensor 11 can detect, as a first distance D1, the distance D from the position of the first ultrasonic sensor 11 to the backward belt surface 20*b*, based on the time between the transmission of the transmission wave S and the reception of the reception wave R, which is the result of being directly reflected on the backward belt surface 20*b*. When the transporting belt 20 is provided with an adhesion layer due to application of the adhesive on the surface of the transporting belt 20, the first ultrasonic sensor 11 can detect, as the first distance D1, the distance D from the position of the first ultrasonic sensor 11 to the backward belt surface 20*b*, based on the time between the transmission of the transmission wave S and the reception of the reception wave R, which is the result of the reflection on the surface of the adhesion layer.

A right mode in FIG. 3 illustrates a state with the washing solution, a foreign matter, or the like remaining on the backward belt surface 20*b*. By way of example, it is assumed that the droplet W of the washing solution remains on the backward belt surface 20*b*. In this case, in the first ultrasonic sensor 11, the first transmission unit 11*a* transmits the transmission wave S onto the backward belt surface 20*b*, and the first reception unit 11*b* receives the reception wave R, which is the transmission wave S reflected on the droplet W remaining on the backward belt surface 20*b*.

When the droplet W of washing solution remains on the backward belt surface 20*b*, the first ultrasonic sensor 11 can detect, as a second distance D2, the distance D from the position of the first ultrasonic sensor 11 to the backward belt surface 20*b*, based on the time between the transmission of the transmission wave S and the reception of the reception wave R, which is the result of the reflection on the droplet W. Note that the second distance D2<the first distance D1 holds.

The first distance D1 as a result of detection on the backward belt surface 20*b* in the state where no washing solution, foreign matter, or the like remains can be detected by the first ultrasonic sensor 11 and stored in the storage unit 17 in advance.

Furthermore, as described below, the user can store a predetermined threshold TH of a value different from the first distance D1 in the storage unit 17 in advance using a touch panel of the notification unit 16 or a peripheral device 3 described below, so that the control unit 10 can use the threshold TH for the determination on the state of the backward belt surface 20*b*.

The control unit 10 compares the distance D detected by the first ultrasonic sensor 11 with the first distance D1 that is a predetermined distance or the threshold TH stored in the storage unit 17, and can determine that the backward belt surface 20*b* is in the state where the droplet W remains when the distance D<the first distance D1 or the distance D<the threshold TH holds. Similarly, also when the foreign matter or the like remains on the backward belt surface 20*b* instead of the droplet W, the control unit 10 compares the distance D when the foreign matter or the like is detected by the first ultrasonic sensor 11 with the first distance D1 or the threshold TH, and can determine that the backward belt surface 20*b* is in a state where the foreign matter or the like remains when the distance D<the first distance D1 or the distance D<the threshold TH holds.

The control unit 10 can use the notification unit 16 described below for notification of information indicating that the washing solution, the foreign matter, or the like remains on the backward belt surface 20*b*.

On the other hand, when the distance D≥the first distance D1 or the distance D≥the threshold TH holds, the control unit 10 can determine that the backward belt surface 20*b* is in the state where no washing solution including the droplet W, no foreign matter, or the like remains. In this case, the control unit 10 can use the notification unit 16 for notification of information indicating that no washing solution, foreign matter, or the like remains on the backward belt surface 20*b*.

Referring back to FIG. 2, the description on the configuration of the recording unit 13 continues. The backward belt surface 20*b* washed by the washing unit 30 is subjected to processing of wiping the washing solution or the foreign matter remaining using the first wiping unit 31. As illustrated in FIG. 2, the first wiping unit 31 is provided downstream of the washing unit 30 and upstream of the recording unit 13 in the rotation direction of the transporting belt 20. The first wiping unit 31 includes a first wiping blade 31*a* and a first adjustment unit 31*b*. The first wiping blade 31*a* may be a rubber piece in a wiper shape, a resin piece in a plate shape, or the like.

During the transport by the transporting belt 20, the first wiping blade 31*a* can wipe the backward belt surface 20*b* moving, with the distal end being in contact with the backward belt surface 20*b*. The first adjustment unit 31*b* is configured to be capable of adjusting the position of the first wiping blade 31*a* upward or downward, under the control by the control unit 10.

Based on the state of the backward belt surface 20*b* that is the result of the detection by the first ultrasonic sensor 11, the control unit 10 can control the position of the first wiping blade 31*a* using the first adjustment unit 31*b*, and adjust a load of the first wiping blade 31*a* in contact with the backward belt surface 20*b*.

A higher position of the first wiping blade 31*a* leads to a larger load of the first wiping blade 31*a* in contact with the backward belt surface 20*b*, resulting in stronger rubbing. A lower position of the first wiping blade 31*a* leads to a smaller load of the first wiping blade 31*a* in contact with the backward belt surface 20*b*, resulting in gentler rubbing.

In this manner, the control unit 10 can control the position of the first wiping blade 31*a* using the first adjustment unit 31*b* to adjust the state of wiping by the first wiping blade 31*a* on the backward belt surface 20*b*.

As described above, a larger load of the first wiping blade 31*a* in contact with the backward belt surface 20*b* leads to a higher effect of the wiping off of the washing solution, the foreign matter, or the like remaining on the backward belt surface 20*b*, but also leads to faster consumption of the glue on the backward belt surface 20*b*. A smaller load affects the wiping effect oppositely.

The control unit 10 uses the first adjustment unit 31*b* to place the first wiping blade 31*a* at a predetermined position to be capable of being in contact with the backward belt surface 20*b* to impose a predetermined load. The control unit 10 can control the first adjustment unit 31*b* based on the result of the detection by the first ultrasonic sensor 11, to increase or decrease the load of the first wiping blade 31*a* on the backward belt surface 20*b*.

Specifically, upon determining that the amount of the washing solution, the foreign matter, or the like remaining on the backward belt surface 20*b* is small as a result of the detection by the first ultrasonic sensor 11, the control unit 10 controls the first adjustment unit 31*b* to move the position of the first wiping blade 31*a* of the first wiping unit 31 downward from the predetermined position continuously or stepwise.

On the other hand, upon determining that the amount of the washing solution, the foreign matter, or the like remaining on the backward belt surface 20*b* is large, the control unit 10 controls the first adjustment unit 31*b* to move the position of the first wiping blade 31*a* of the first wiping unit 31 upward from the predetermined position continuously or stepwise.

Based on the result of the detection by the first ultrasonic sensor 11, the control unit 10 can increase or decrease the load of the first wiping blade 31*a* on the backward belt surface 20*b* continuously or stepwise. Based on the result of the detection by the first ultrasonic sensor 11, the control unit 10 can control the first wiping unit 31 and appropriately remove the washing solution or the foreign matter remaining, while suppressing the consumption of the glue on the backward belt surface 20*b*.

The communication unit 15 illustrated in FIG. 1 includes a communication circuit capable of communicating with the peripheral device 3 by wired or wireless communications. The peripheral device 3 is, for example, a computer, a server, or the like. The communication unit 15 receives recording data to be recorded on the medium M, from the peripheral device 3. The recording data may be stored in the storage unit 17, or may be read from a storage medium by a reading device provided to the storage unit 17.

As described above, the communication unit 15 can receive the threshold TH input by the user, from the peripheral device 3. The control unit 10 can store the threshold TH, received by the communication unit 15, in the storage unit 17, and use the threshold TH for determining the state of the backward belt surface 20*b*.

As illustrated in FIG. 1, the recording device 1 includes the notification unit 16 including a touch panel. The notification unit 16 may include a speaker. Specifically, the notification unit 16 can notify the user of information, by means of displaying of a message or the like on the touch panel, sound from the speaker, or the like.

The threshold TH can be set by the user using the touch panel of the notification unit 16. The control unit 10 can also store the threshold TH, acquired from the touch panel, in the storage unit 17.

As described above, the control unit 10 can compare the distance D detected by the first ultrasonic sensor 11 with the first distance D1 or the threshold TH stored in the storage unit 17, and use the notification unit 16 to notify the user of information indicating that the washing solution, the foreign matter, or the like remains on the backward belt surface 20*b* when the distance D<the first distance D1 or the distance D<the threshold TH holds.

When the distance D the first distance D1 or the distance D≥the threshold TH holds, the control unit 10 can determine that the backward belt surface 20*b* is in the state where no washing solution, foreign matter, or the like remains, and use the notification unit 16 for notification of information indicating that no washing solution, foreign matter, or the like remains on the backward belt surface 20*b*.

1-2. Configuration of Recording Device According to Second Embodiment

Figure 4:
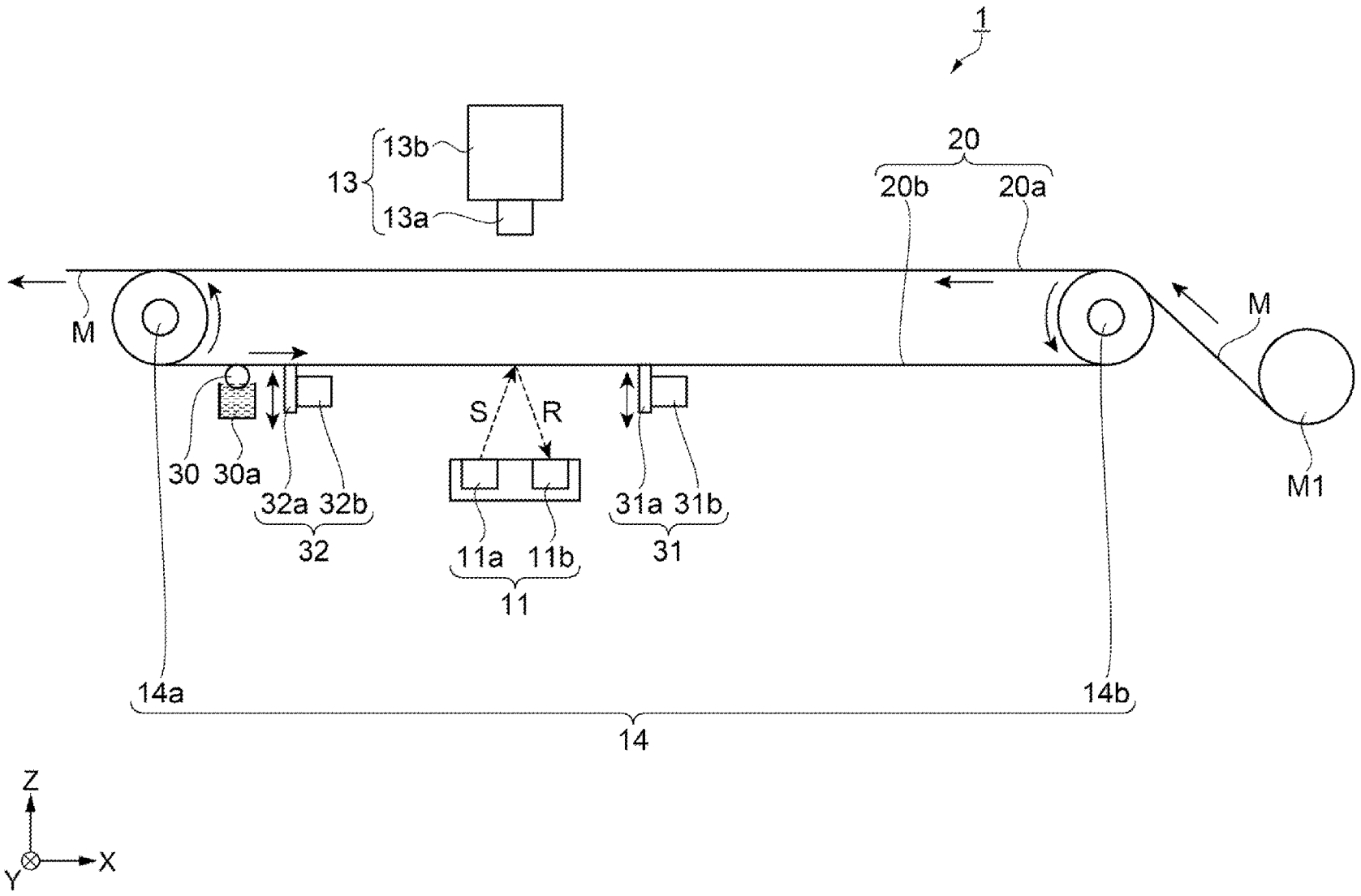
FIG. 4 is a schematic view illustrating a configuration of a recording device according to a second embodiment.

The recording device 1 according to the second embodiment illustrated in FIG. 4 is different from the recording device 1 according to the first embodiment illustrated in FIG. 2 in that the second wiping unit 32 is provided downstream of the washing unit 30 and upstream of the first ultrasonic sensor 11 in the rotation direction of the transporting belt 20. The other components of the recording device 1 according to the second embodiment are the same as those in the recording device 1 according to the first embodiment including their reference signs as described above, and the description thereof will be omitted.

The second wiping unit 32 illustrated in FIG. 4 has a configuration similar to that of the first wiping unit 31, and includes a second wiping blade 32*a* and a second adjustment unit 32*b*.

In the rotation direction of the transporting belt 20, the first ultrasonic sensor 11 is capable of performing the detection by transmitting and receiving ultrasonic waves onto at least part of a region, of the backward belt surface 20*b*, from the downstream of the second wiping unit 32 to the upstream of the recording unit 13 and the upstream of the first wiping unit 31. In other words, the second wiping unit 32 is disposed upstream of the first wiping unit 31 in the rotation direction of the transporting belt 20, and the first ultrasonic sensor 11 is disposed upstream of the first wiping unit 31 and downstream of the second wiping unit 32 in the rotation direction of the transporting belt 20.

The control unit 10 uses the second adjustment unit 32*b* to place the second wiping blade 32*a* at a predetermined position to be capable of being in contact with the backward belt surface 20*b* to impose a predetermined load. As with the first wiping unit 31, the control unit 10 can control the second adjustment unit 32*b* based on the result of the detection by the first ultrasonic sensor 11, to increase or decrease the load of the second wiping blade 32*a* on the backward belt surface 20*b*.

Based on the result of the detection by the first ultrasonic sensor 11, the control unit 10 can control the second wiping unit 32 on the upstream to wipe the backward belt surface 20*b*, and further control the first wiping unit 31 on the downstream to wipe the backward belt surface 20*b*. Using the first wiping unit 31 and the second wiping unit 32, the control unit 10 can appropriately remove the washing solution or the foreign matter remaining on the backward belt surface 20*b* after being washed by the washing unit 30, while suppressing the consumption of the glue on the backward belt surface 20*b*.

The second wiping unit 32 need not include the second adjustment unit 32*b*, and the second wiping blade 32*a* may be disposed at a predetermined position to be capable of being in contact with the backward belt surface 20*b* while imposing a predetermined load.

The second wiping blade 32*a* of the second wiping unit 32 disposed at the predetermined position wipes the washing solution or the foreign matter remaining on the backward belt surface 20*b* after being washed by the washing unit 30.

The control unit 10 can use the first ultrasonic sensor 11 to perform the detection on the backward belt surface 20*b* wiped by the second wiping unit 32 on the upstream, and based on the result of the detection, control the first adjustment unit 31*b* of the first wiping unit 31 on the downstream to increase or decrease the load of the first wiping blade 31*a* on the backward belt surface 20*b*.

Specifically, the control unit 10 can compare the distance D detected by the first ultrasonic sensor 11 with the first distance D1 or the threshold TH stored in the storage unit 17 and control the first adjustment unit 31*b* of the first wiping unit 31 on the downstream to increase the load of the first wiping blade 31*a* on the backward belt surface 20*b* when the distance D<the first distance D1 or the distance D<the threshold TH holds.

When the washing solution or the foreign matter remains on the backward belt surface 20*b* after being washed by the second wiping unit 32 at the predetermined position on the upstream, the control unit 10 can control the first adjustment unit 31*b* of the first wiping unit 31 on the downstream to appropriately remove the washing solution or the foreign matter remaining on the backward belt surface 20*b*.

1-3. Configuration of Recording Device According to Third Embodiment

Figure 5:
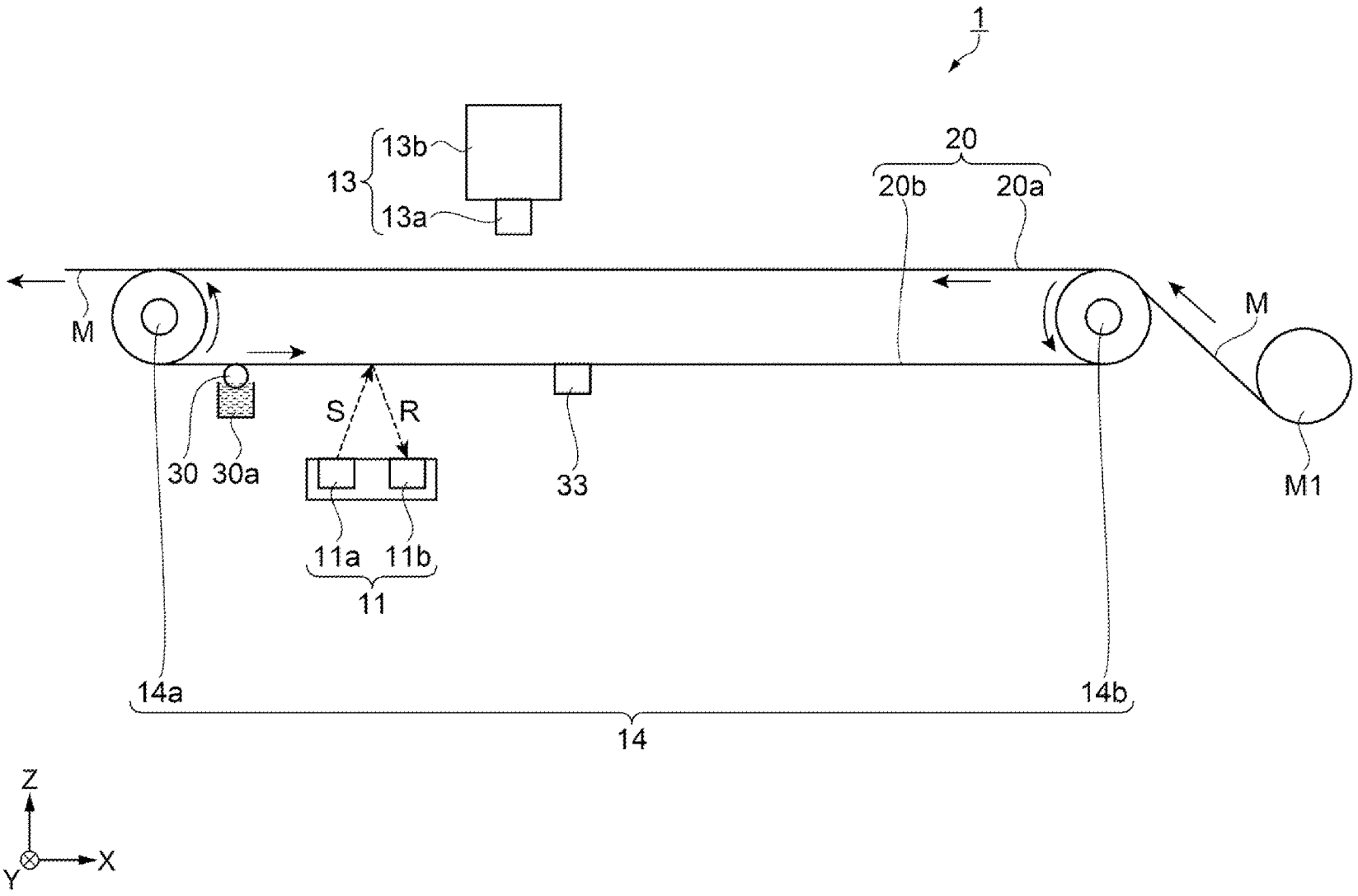
FIG. 5 is a schematic view illustrating a configuration of a recording device according to a third embodiment.

The recording device 1 according to the third embodiment illustrated in FIG. 5 is different from the recording device 1 according to the first embodiment illustrated in FIG. 2 in that the drying unit 33 is provided instead of the first wiping unit 31. The other components of the recording device 1 according to the third embodiment are the same as those in the recording device 1 according to the first embodiment including their reference signs as described above, and the description thereof will be omitted.

The drying unit 33 is provided downstream of the first ultrasonic sensor 11 and upstream of the recording unit 13 in the rotation direction of the transporting belt 20. The drying unit 33 is provided downstream of the washing unit 30 in the rotation direction of the transporting belt 20.

In the rotation direction of the transporting belt 20, the first ultrasonic sensor 11 is capable of performing the detection by transmitting and receiving ultrasonic waves onto at least part of a region, of the backward belt surface 20*b*, from the downstream of the washing unit 30 to the upstream of the recording unit 13 and the upstream of the drying unit 33. In other words, the first ultrasonic sensor 11 is disposed downstream of the washing unit 30 and upstream of the drying unit 33.

The drying unit 33 includes at least one of a blower or a heater. The drying unit 33 can, in a contactless manner, dry off the washing solution remaining on the backward belt surface 20*b* washed by the washing unit 30, by using at least one of air flow from the blower or heat of the heater.

Based on the state of the backward belt surface 20*b* detected by the first ultrasonic sensor 11, the control unit 10 can control the air flow per unit time from the blower or an output such as the wattage of the heater of the drying unit 33, to appropriately adjust the drying state of the backward belt surface 20*b*.

For example, the control unit 10 can increase the air flow from the drying unit 33 or the output of the heater, upon determining that the washing solution remains on the backward belt surface 20*b* or that the amount of such a washing solution remaining is large, based on the result of the detection of the first ultrasonic sensor 11.

Specifically, the control unit 10 can compare the distance D detected by the first ultrasonic sensor 11 with the first distance D1 or the threshold TH stored in the storage unit 17, and increase the air flow from the drying unit 33 or the output of the heater when the distance D<the first distance D1 or the distance D<the threshold TH holds.

On the other hand, the control unit 10 can reduce the air flow from the drying unit 33 or the output of the heater, upon determining that the washing solution does not remain on the backward belt surface 20*b* or that the amount of such a washing solution remaining is small, based on the result of the detection of the first ultrasonic sensor 11.

1-4. Configuration of Recording Device According to Fourth Embodiment

Figure 6:
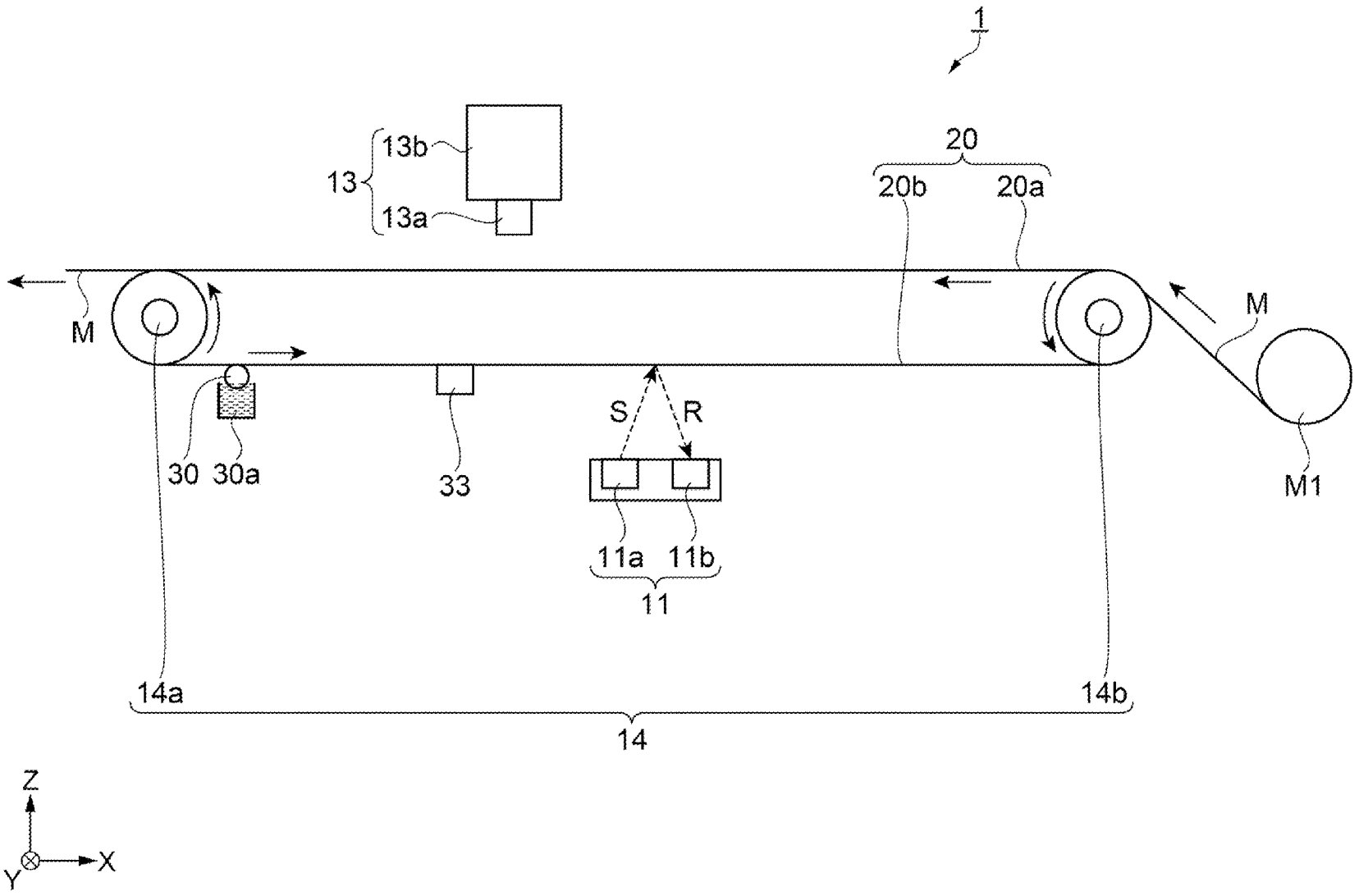
FIG. 6 is a schematic view illustrating a configuration of a recording device according to a fourth embodiment.

The recording device 1 according to the fourth embodiment illustrated in FIG. 6 is different from the recording device 1 according to the third embodiment illustrated in FIG. 5 in the position of the drying unit 33 disposed. The drying unit 33 is provided downstream of the washing unit 30 and upstream of the first ultrasonic sensor 11 in the rotation direction of the transporting belt 20. The other components of the recording device 1 according to the fourth embodiment are the same as those in the recording device 1 according to the third embodiment including their reference signs as described above, and the description thereof will be omitted.

In the rotation direction of the transporting belt 20, the first ultrasonic sensor 11 is capable of performing the detection by transmitting and receiving ultrasonic waves onto at least part of a region, of the backward belt surface 20*b*, from the downstream of the washing unit 30 and the downstream of the drying unit 33 to the upstream of the recording unit 13. In other words, the drying unit 33 is disposed downstream of the washing unit 30 and upstream of the recording unit 13 in the rotation direction of the transporting belt 20, and the first ultrasonic sensor 11 is disposed downstream of the drying unit 33 and upstream of the recording unit 13 in the rotation direction of the transporting belt 20.

For example, it is assumed that the control unit 10 has determined that the washing solution remains on the backward belt surface 20*b* that has been washed by the washing unit 30 and subjected to drying processing by the drying unit 33 or that the amount of such a washing solution is large based on the result of the detection by the first ultrasonic sensor 11. In this case, the control unit 10 can use the notification unit 16 to notify the user of the information indicating that the washing solution or the like remains on the backward belt surface 20*b* after the drying processing by the drying unit 33.

The user can operate the touch panel of the notification unit 16 or the peripheral device 3 to instruct the control unit 10 of the recording device 1 to increase the air flow from the drying unit 33 or the output of the heater.

On the other hand, it is assumed that the control unit 10 has determined that no washing solution remains on the backward belt surface 20*b* that has been washed by the washing unit 30 and subjected to drying processing by the drying unit 33 or that the amount of such a washing solution remaining is small based on the result of the detection by the first ultrasonic sensor 11. In this case, the control unit 10 can use the notification unit 16 to notify the user of the information indicating that no washing solution or the like remains on the backward belt surface 20*b* after the drying processing by the drying unit 33.

The user can recognize that that he or she can continue using the recording device 1, without the need to perform an operation on the recording device 1.

1-5. Example of Control Method for Recording Device

An example of a control method for the recording device 1 will be described mainly with reference to a flowchart in FIG. 7, and also to FIG. 1 to FIG. 6.

The control unit 10 illustrated in FIG. 1 acquires recording data from the peripheral device 3 using the communication unit 15, or acquires recording data from the storage unit 17 in response to an operation on the touch panel of the notification unit 16 by the user.

Upon acquiring the recording data, the control unit 10 transports the medium M using the transport unit 14 (S101). Specifically, as illustrated in FIG. 2, the control unit 10 drives the driving roller 14*a* of the transport unit 14, to make the transporting belt 20 rotate in the rotation direction. The surface of the transporting belt 20 is provided with glue, so that the medium M can be transported while being adhered and fixed on the forward belt surface 20*a*.

When the medium M is transported to the position of the recording unit 13 by the transport unit 14, the control unit 10 performs the recording on the medium M using the recording unit 13 based on the recording data. With a transport device 2, this processing is not executed as will be described below.

The control unit 10 can further transport the medium M using the transport unit 14, and peel the medium M on which the recording by the recording unit 13 has been completed, from the forward belt surface 20*a*.

The backward belt surface 20*b*, from which the medium M has been peeled off, is washed by the washing unit 30. The washing unit 30 can remove the ink, the foreign matter, or the like attached on the backward belt surface 20*b*.

As illustrated in FIG. 2, the first ultrasonic sensor 11 performs the detection by transmitting and receiving ultrasonic waves onto a detection target region that is at least part of a region, in the backward belt surface 20*b*, from the downstream of the washing unit 30 to the upstream of the recording unit 13 in the rotation direction of the transporting belt 20.

The first ultrasonic sensor 11 detects the distance D to the backward belt surface 20*b* (S102). The control unit 10 compares the distance D detected by the first ultrasonic sensor 11 with the first distance D1, which is a predetermined distance, or the threshold TH stored in the storage unit 17 (S103).

As illustrated in FIG. 3, for example, when the droplet W of the washing solution remains on the backward belt surface 20*b*, the first ultrasonic sensor 11 detects the second distance D2. On the other hand, when no washing solution remains on the backward belt surface 20*b*, the first ultrasonic sensor 11 detects the first distance D1. The second distance D2<the first distance D1 holds.

Upon determining that the distance D<the first distance D1 or the distance D<the threshold TH holds (S103: YES), the control unit 10 can determine that the backward belt surface 20*b* is in the state where the washing solution, the foreign matter, or the like remains.

Then, the control unit 10 can make the notification unit 16, the first wiping unit 31, or the drying unit 33 operate (S104).

On the other hand, upon determining that the distance D the first distance D1 or the distance D the threshold TH holds (S103: NO), the control unit 10 can determine that the backward belt surface 20*b* is in the state where no washing solution, foreign matter, or the like remains. The control unit 10 continues the detection of the distance D to the backward belt surface 20*b* by the first ultrasonic sensor 11 (S102).

A specific operation (S104) of the notification unit 16, the first wiping unit 31, or the drying unit 33, which is performed when the control unit 10 determines that the backward belt surface 20*b* is in the state where the washing solution, the foreign matter, or the like remains, will be described below.

In the recording device 1 according to the first embodiment illustrated in FIG. 2, the first wiping unit 31 is disposed downstream of the first ultrasonic sensor 11 in the rotation direction of the transporting belt 20.

Upon determining that the backward belt surface 20*b* is in the state where the washing solution, the foreign matter, or the like remains, the control unit 10 controls the first adjustment unit 31*b* of the first wiping unit 31 to move the position of the first wiping blade 31*a* upward to increase the load on the backward belt surface 20*b*. In this manner, the control unit 10 can facilitate the removal of the washing solution or the foreign matter remaining on the backward belt surface 20*b*.

In the recording device 1 according to the second embodiment illustrated in FIG. 4, the second wiping unit 32 is disposed upstream of the first ultrasonic sensor 11 and the first wiping unit 31 is disposed downstream of the first ultrasonic sensor 11 in the rotation direction of the transporting belt 20.

Upon determining that the backward belt surface 20*b* is in the state where the washing solution, the foreign matter, or the like remains, the control unit 10 controls at least the first adjustment unit 31*b* of the first wiping unit 31 to move the position of the first wiping blade 31*a* upward to increase the load on the backward belt surface 20*b*. The control unit 10 may control the second adjustment unit 32*b* of the second wiping unit 32 to also move the position of the second wiping blade 32*a* upward to increase the load on the backward belt surface 20*b*.

In the recording device 1 according to the third embodiment illustrated in FIG. 5, the drying unit 33 is disposed downstream of the first ultrasonic sensor 11 in the rotation direction of the transporting belt 20.

Upon determining that the backward belt surface 20*b* is in the state where the washing solution remains, the control unit 10 performs control to increase the air flow from the drying unit 33 or the output of the heater. In this manner, the control unit 10 can facilitate the drying off of the washing solution remaining on the backward belt surface 20*b*.

In the recording device 1 according to the fourth embodiment illustrated in FIG. 6, the drying unit 33 is disposed upstream of the first ultrasonic sensor 11 in the rotation direction of the transporting belt 20.

Upon determining that the backward belt surface 20*b* is in the state where the washing solution remains, the control unit 10 uses the notification unit 16 to notify the user of the information indicating that the washing solution or the like remains on the backward belt surface 20*b* after the drying processing by the drying unit 33. The user can operate the touch panel of the notification unit 16 or the peripheral device 3 to instruct the recording device 1 to increase the air flow from the drying unit 33 or the output of the heater.

As described above, upon determining that the backward belt surface 20*b* is in the state where the washing solution, the foreign matter, or the like remains thereon, the control unit 10 can operate at least one of the notification unit 16, the first wiping unit 31, or the drying unit 33 as described above.

1-6. Configuration of Recording Device According to Fifth Embodiment

Figure 8:
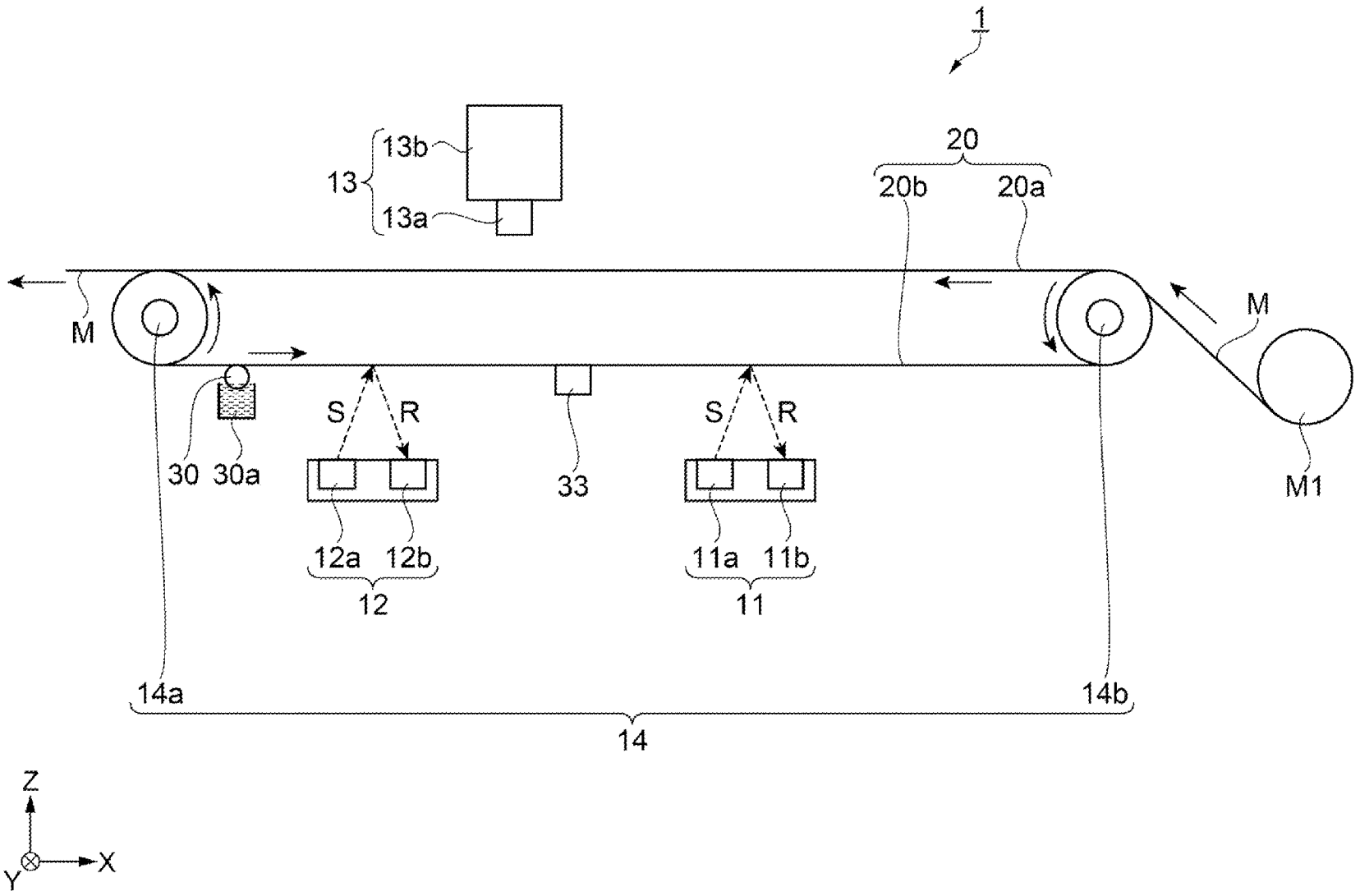
FIG. 8 is a schematic view illustrating a configuration of a recording device according to a fifth embodiment.

The recording device 1 according to the fifth embodiment illustrated in FIG. 8 is different from the recording device 1 according to the fourth embodiment illustrated in FIG. 6 in that the second ultrasonic sensor 12 as another ultrasonic sensor is provided downstream of the washing unit 30 and upstream of the drying unit 33 in the rotation direction of the transporting belt 20.

The recording device 1 according to the fifth embodiment illustrated in FIG. 8 is different from the recording device 1 according to the third embodiment illustrated in FIG. 5 in that the second ultrasonic sensor 12 is provided instead of the first ultrasonic sensor 11, and that the first ultrasonic sensor 11 as another ultrasonic sensor is provided downstream of the drying unit 33 and upstream of the recording unit 13 in the rotation direction of the transporting belt 20.

Specifically, in the recording device 1 according to the fifth embodiment, the second ultrasonic sensor 12 is disposed upstream of the drying unit 33 in the rotation direction, and the first ultrasonic sensor 11 is disposed downstream of the drying unit 33 in the rotation direction. Accordingly, when the first ultrasonic sensor 11 is an ultrasonic sensor, the second ultrasonic sensor 12 can be regarded as another ultrasonic sensor different from the first ultrasonic sensor 11. Alternatively, when the second ultrasonic sensor 12 is an ultrasonic sensor, the first ultrasonic sensor 11 can be regarded as another ultrasonic sensor different from the second ultrasonic sensor 12. The other components of the recording device 1 according to the fifth embodiment are the same as those in the recording device 1 according to the third embodiment and the fourth embodiment as described above, and the description thereof will be omitted.

The second ultrasonic sensor 12 disposed upstream of the drying unit 33 in the rotation direction of the transporting belt 20 has a configuration that is similar to that of the first ultrasonic sensor 11 disposed downstream of the drying unit 33, and includes a second transmission unit 12*a*, which is a transmitter that transmits the transmission wave S, and a second reception unit 12*b*, which is a receiver that receives the reception wave R.

The second ultrasonic sensor 12 is capable of performing the detection by transmitting and receiving ultrasonic waves onto at least part of a region, of the backward belt surface 20*b*, from the downstream of the washing unit 30 to the upstream of the recording unit 13 and the upstream of the drying unit 33 in the rotation direction of the transporting belt 20. The first ultrasonic sensor 11 is capable of performing the detection by transmitting and receiving ultrasonic waves onto at least part of a region, of the backward belt surface 20*b*, from the downstream of the drying unit 33 to the upstream of the recording unit 13.

The second ultrasonic sensor 12 performs detection on the backward belt surface 20*b* that has been subjected to the washing processing by the washing unit 30. The control unit 10 compares a distance DA that is the distance D detected by the second ultrasonic sensor 12 with the first distance D1 that is a predetermined distance or the threshold TH stored in the storage unit 17, and can determine that the backward belt surface 20*b* is in the state where the washing solution, the foreign matter, or the like remains, when the distance DA<the first distance D1 or the distance DA<the threshold TH holds.

Upon determining that the backward belt surface 20*b* is in the state where the washing solution, the foreign matter, or the like remains, the control unit 10 can perform control to increase the air flow from the drying unit 33 or the output of the heater.

On the other hand, when the distance DA the first distance D1 or the distance DA the threshold TH holds, the control unit 10 can determine that the backward belt surface 20*b* is in the state where no washing solution, foreign matter, or the like remains.

The first ultrasonic sensor 11 performs detection on the backward belt surface 20*b* that has been subjected to the drying processing by the drying unit 33. As with the second ultrasonic sensor 12, the control unit 10 compares a distance DB that is the distance D detected with the first distance D1 that is a predetermined distance or the threshold TH stored in the storage unit 17, and can determine that the backward belt surface 20*b* is in the state where the washing solution, the foreign matter, or the like remains, when the distance DB<the first distance D1 or the distance DB<the threshold TH holds.

On the other hand, when the distance DB the first distance D1 or the distance DB the threshold TH holds, the control unit 10 can determine that the backward belt surface 20*b* is in the state where no washing solution, foreign matter, or the like remains.

Next, the control unit 10 compares the distance DA, which is the result of the detection by the second ultrasonic sensor 12 on the upstream and the distance DB, which is the result of the detection by the first ultrasonic sensor 11 on the downstream with the first distance D1 or the threshold TH.

When the distance DA≥the first distance D1 and the distance DB≥the first distance D1 hold, the control unit 10 can determine that the backward belt surface 20*b* is in the state where no washing solution, foreign matter, or the like remains, on the upstream and the downstream of the drying unit 33 in the rotation direction of the transporting belt 20. Note that the control unit 10 may perform the determination based on the threshold TH instead of the first distance D1.

When the distance DA<the first distance D1 and the distance DB<the first distance D1 hold, the control unit 10 can determine that the washing solution, the foreign matter, or the like remains on the backward belt surface 20*b* on the upstream and the downstream of the drying unit 33 in the rotation direction of the transporting belt 20. Furthermore, when the distance DA<the distance DB holds, the control unit 10 can determine that the amount of substance remaining on the backward belt surface 20*b* is reduced on the downstream of the drying unit 33 compared with that on the upstream. Note that the control unit 10 may perform the determination based on the threshold TH instead of the first distance D1.

As a result, the control unit 10 can determine that the substance remaining on the backward belt surface 20*b* is a liquid such as a washing solution. The control unit 10 can determine that the liquid such as a washing solution remains on the backward belt surface 20*b* before the drying processing by the drying unit 33, and that a certain amount of liquid water is dried off or evaporated by the drying unit 33 but the liquid still remains on the backward belt surface 20*b*.

Thus, the control unit 10 can perform control to increase the air flow from the drying unit 33 or the output of the heater, to facilitate the drying off of the liquid such as a washing solution remaining on the backward belt surface 20*b*.

Furthermore, the control unit 10 can use the notification unit 16 for notification of information indicating that the liquid such as a washing solution is still remaining on the backward belt surface 20*b*.

On the other hand, upon determining that the distance DA=the distance DB<the first distance D1 or the distance DA=the distance DB<the threshold TH holds, the control unit 10 can determine that the washing solution, the foreign matter, or the like remains on the backward belt surface 20*b* on the upstream and the downstream of the drying unit 33 in the rotation direction of the transporting belt 20. Furthermore, because the distance DA=the distance DB holds, the control unit 10 can determine or anticipate that the amount of substance remaining on the backward belt surface 20*b* is not reduced on the downstream of the drying unit 33 compared with that on the upstream, despite the drying processing performed by the drying unit 33.

As a result, the control unit 10 can determine that the substance remaining on the backward belt surface 20*b* is not a liquid such as a washing solution but is a solid foreign matter. The foreign matter is, for example, fluff separated from the medium M or the like.

When the backward belt surface 20*b* passes through the driven roller 14*b*, the medium M is transported while being placed on the forward belt surface 20*a*, so that the recording can be performed thereon by the recording unit 13.

Under conditions where the control unit 10 has determined that the distance DA<the distance DB<the first distance D1 holds and the backward belt surface 20*b* is in the state where a liquid such as a washing solution remains, when the medium M is placed on the forward belt surface 20*a*, the washing solution or the like remaining soaks into the medium M.

Under conditions where the control unit 10 has determined that the distance DA=the distance DB<the first distance D1 holds and the backward belt surface 20*b* is in the state where the foreign matter or the like remains, when the medium M is placed on the forward belt surface 20*a*, the medium M is placed over the foreign matter or the like on the forward belt surface 20*a* to be lifted from the forward belt surface 20*a*. As a result, the distance between the medium M and the recording unit 13 varies, and the recording unit 13 fails to appropriately perform the recording on the medium M.

In any case, the quality of the result of the recording on the medium M may be compromised.

Thus, upon determining that the distance DA<the distance DB<the first distance D1 and the distance DA=the distance DB<the first distance D1 hold even when the output of the drying unit 33 has been changed, the control unit 10 may stop the operation of transporting the medium M by the transport unit 14. Specifically, the control unit 10 changes the output of the drying unit 33 based on the result of comparison between the distance DA and the first distance D1. For example, if it is determined that the distance DA<the first distance D1 holds, the output of the drying unit 33 is increased. Then, when the distance DA=the distance DB<the first distance D1 holds or the distance DA<the distance DB<the first distance D1 holds, the control unit 10 stops the operation of transporting the medium M by the transport unit 14. This is because the fact that the distance DA=the distance DB<the first distance D1 holds or the distance DA<the distance DB<the first distance D1 holds indicates that the substance remaining on the backward belt surface 20*b* is difficult to remove even when the output of the drying unit 33 is increased. In particular, when the distance DA=the distance DB<the first distance D1 holds, the substance remaining on the backward belt surface 20*b* is likely to be a solid substance as described above, which is difficult to remove. When the recording unit 13 is performing recording on the medium M in this case, the control unit 10 also stops the recording operation by the recording unit 13.

The control unit 10 can use the notification unit 16 for notification of information indicating that removable of the washing solution, foreign matter, or the like on the backward belt surface 20*b* has failed. Furthermore, the control unit 10 can use the notification unit 16 for notification of information indicating that the transport unit 14 and the recording unit 13 have been stopped.

1-7. Another Example of Control Method for Recording Device

Another example of a control method for the recording device 1 will be described mainly with reference to a flowchart in FIG. 9, and also to FIG. 8.

The control unit 10 illustrated in FIG. 1 acquires recording data from the peripheral device 3 using the communication unit 15, or acquires recording data from the storage unit 17 in response to an operation on the touch panel of the notification unit 16 by the user.

The control unit 10 transports the medium M using the transport unit 14 and performs the recording on the medium M using the recording unit 13 based on the recording data (S201). With a transport device 2, this processing is not executed as will be described below.

The backward belt surface 20*b*, from which the medium M after the recording has been peeled off, is washed by the washing unit 30.

As illustrated in FIG. 8, the first ultrasonic sensor 11 detects the distance DA to the backward belt surface 20*b*, in a region, of the backward belt surface 20*b*, from the downstream of the washing unit 30 to the upstream of the drying unit 33 in the rotation direction of the transporting belt 20 (S202).

The second ultrasonic sensor 12 detects the distance DB to the backward belt surface 20*b*, in a region, of the backward belt surface 20*b*, from the downstream of the drying unit 33 to the upstream of the recording unit 13 in the rotation direction of the transporting belt 20 (S202).

Next, the control unit 10 performs comparison between the distance DA and the distance DB, which are the respective detection results of the first ultrasonic sensor 11 and the second ultrasonic sensor 12. Specifically, the control unit 10 determines whether the distance DA=the distance DB<the first distance D1 or the distance DA=the distance DB<the threshold TH holds (S203).

Upon determining that the distance DA=the distance DB<the first distance D1 or the distance DA=the distance DB<the threshold TH holds (S203: YES), the control unit 10 stops the operation of transporting the medium M by the transport unit 14, and when the recording is performed on the medium M by the recording unit 13, also stops the recording operation by the recording unit 13 (S204). The control unit 10 can determine that a foreign matter or the like remains on the backward belt surface 20*b*, and stop the operations of the transport unit 14 and the recording unit 13.

The control unit 10 may stop the operation of transporting the medium M by the transport unit 14 and stop the recording operation by the recording unit 13 upon determining that the distance DA<the distance DB<the first distance D1 or the threshold TH holds. The control unit 10 can determine that the washing solution or the like remains on the backward belt surface 20*b* despite the drying processing performed by the drying unit 33, and stop the operations of the transport unit 14 and the recording unit 13.

Upon determining that the distance DA=the distance DB<the first distance D1 or the threshold TH does not hold (S203: NO), the control unit 10 continues the detection of the distance DA to the backward belt surface 20*b* by the first ultrasonic sensor 11 and the detection of the distance DB to the backward belt surface 20*b* by the second ultrasonic sensor 12 (S202).

2. Configuration of Transport Device

Figure 10:
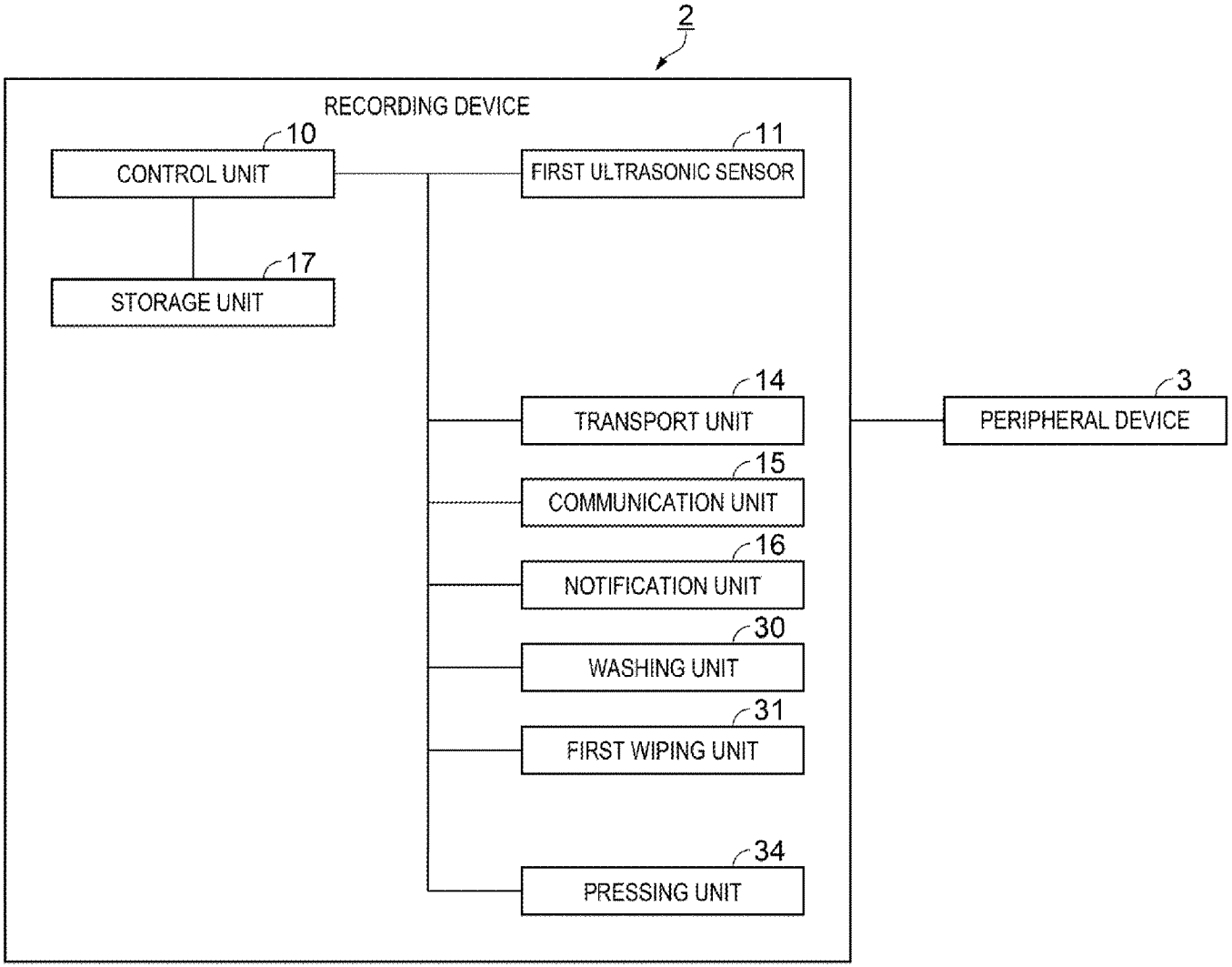
FIG. 10 is a block diagram illustrating a configuration of a transport device according to an embodiment.
Figure 11:
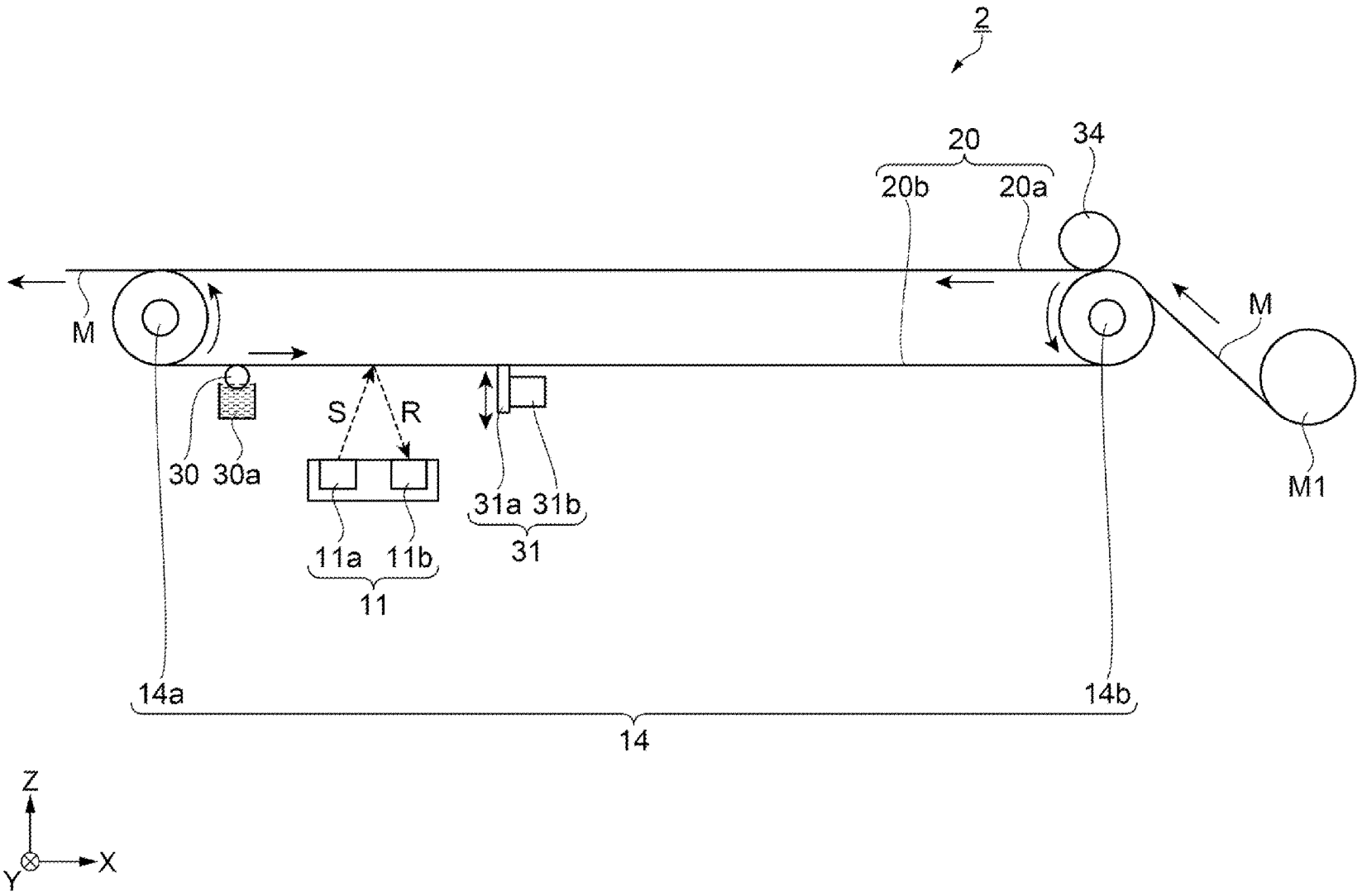
FIG. 11 is a schematic view illustrating a configuration of the transport device according to the embodiment.

As illustrated in FIG. 10 and FIG. 11, the transport device 2 has a configuration as a result of removing at least the recording unit 13 from the recording device 1 according to the first embodiment illustrated in FIG. 2, and the common parts are denoted by the common reference signs. The transport device 2 includes the control unit 10, the storage unit 17, the first ultrasonic sensor 11, the transport unit 14, the communication unit 15, the notification unit 16, the washing unit 30, the first wiping unit 31, and a pressing unit 34.

As illustrated in FIG. 11, assuming that the driving roller 14*a* of the transport unit 14 serves as the starting point, the washing unit 30, the first ultrasonic sensor 11, the first wiping unit 31, and the pressing unit 34 are arranged in this order from the upstream to the downstream in the rotation direction of the transporting belt 20. The first ultrasonic sensor 11 is configured to be capable of performing the detection by transmitting and receiving ultrasonic waves onto a detection target region that is at least part of a region, in the backward belt surface 20*b*, from the downstream of the washing unit 30 to the upstream of the pressing unit 34 in the rotation direction of the transporting belt 20.

The pressing unit 34 illustrated in FIG. 11 is, for example, a pressing roller. The pressing unit 34 presses the medium M pulled out from the roll body Ml onto the forward belt surface 20*a* of the transport unit 14. As described above, the forward belt surface 20*a* is provided with glue. With the pressing unit 34, the medium M is more reliably adhered and fixed on the forward belt surface 20*a*, by means of the glue on the forward belt surface 20*a*. The transport device 2 may include a movement mechanism that moves the pressing unit 34. The control unit 10 can move the pressing unit 34 by controlling the movement mechanism, and adjust the pressing force applied by the pressing unit 34 onto the medium M.

Although the recording device 1 illustrated in FIG. 2 does not include the pressing unit 34, the recording device 1 may be provided with the pressing unit 34, as in the transport device 2 illustrated in FIG. 11.

The control unit 10 reads firmware of the storage unit 17, and performs control for transporting the medium M with the transport unit 14. For the backward belt surface 20*b* that is the surface of the transporting belt 20 after the transport of the medium M, the control unit 10 controls the washing by the washing unit 30, the detection of the state of the backward belt surface 20*b* by the first ultrasonic sensor 11, the wiping off of the washing solution by the first wiping unit 31 based on the result of the detection, notification by the notification unit 16 or the communication unit 15, and the like, along the rotation direction of the transporting belt 20.

The parts of the transport device 2 common to those in the recording device 1 are the same as those in the recording device 1 described above, and thus the description thereof will be omitted.

The embodiments of the recording device 1 described above similarly are applied to the transport device 2, except for the recording unit 13, and thus the description thereof will be omitted. Specifically, the first embodiment illustrated in FIG. 2, the second embodiment illustrated in FIG. 4, the third embodiment illustrated in FIG. 5, and the fourth embodiment illustrated in FIG. 6 of the recording device 1 described above can be similarly applied to the transport device 2, except for the recording unit 13.

Figure 7:
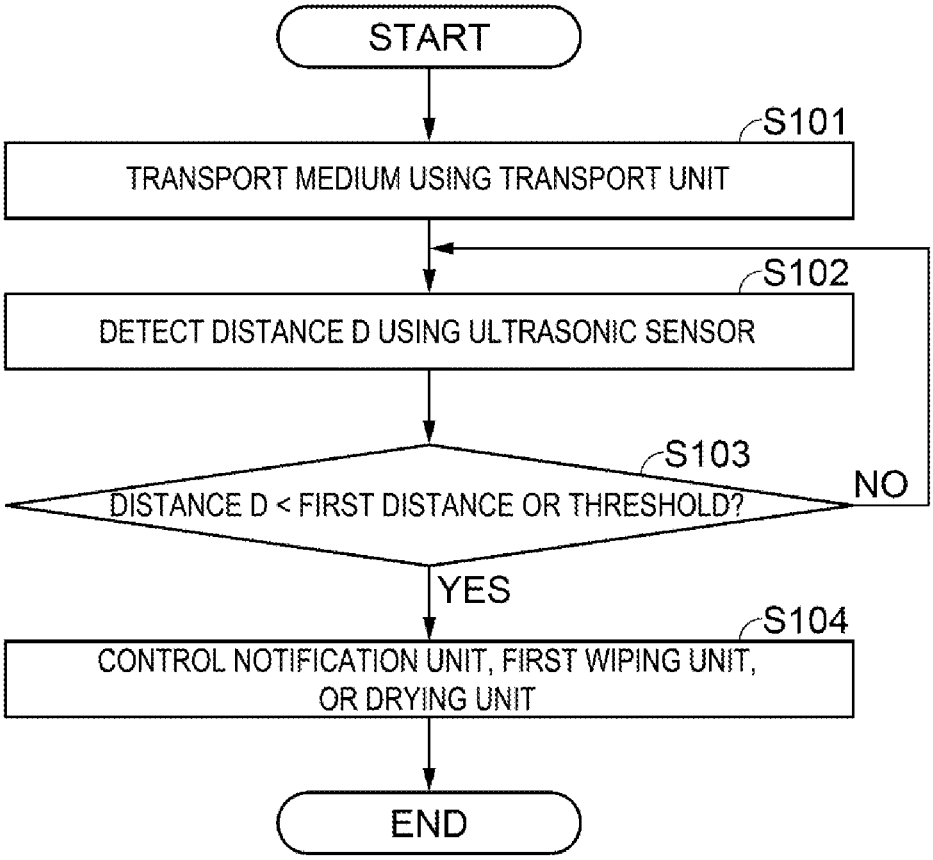
FIG. 7 is a flowchart illustrating an example of a method of control performed by a control unit.
Figure 9:
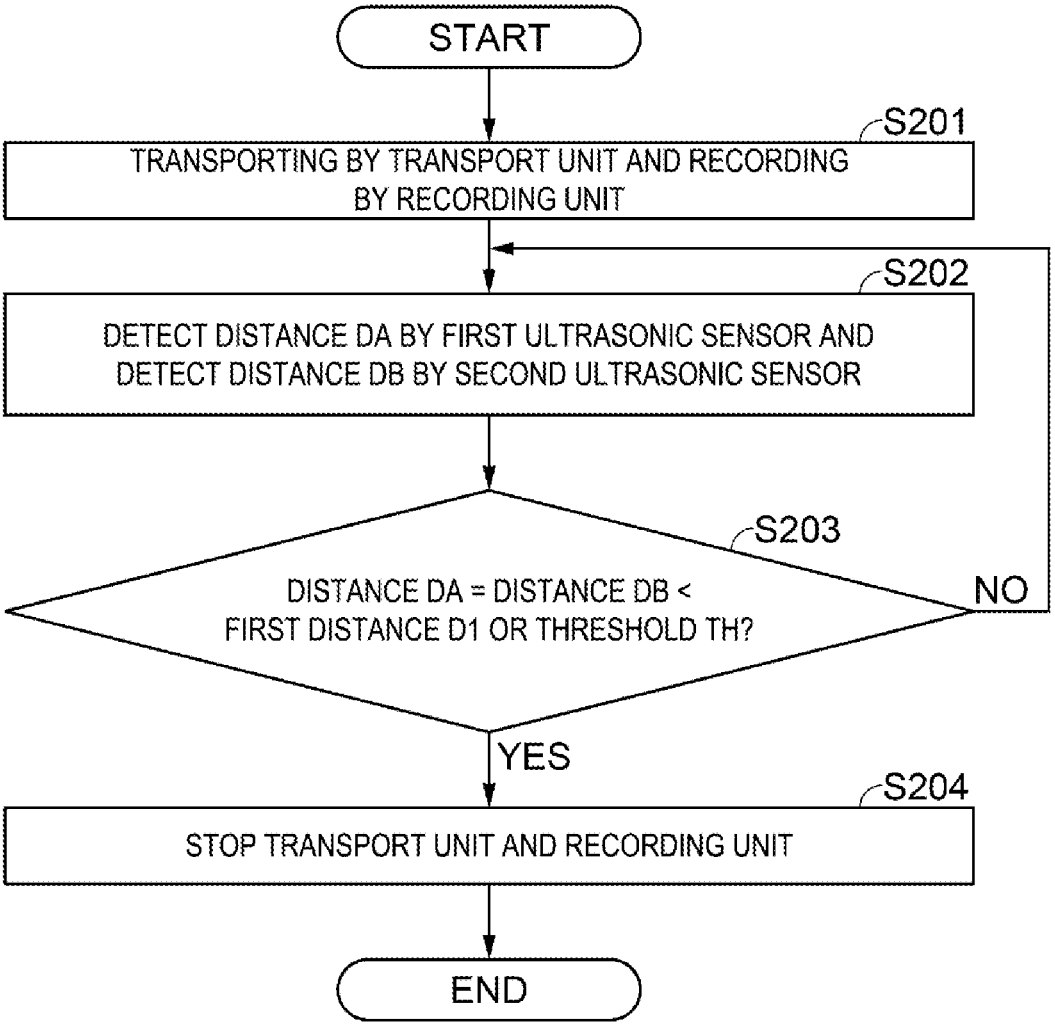
FIG. 9 is a flowchart illustrating another example of the method of control performed by the control unit.

Furthermore, the above-described example of the control method for the recording device 1 illustrated in the flowchart in FIG. 7, and the above-described other example of the control method for the recording device 1 illustrated in the flowchart in FIG. 9 can be similarly applied to the control method for the transport device 2 except for the recording unit 13, and thus the description thereof will be omitted.

As described above, with the recording device 1 and the transport device 2, at least one of the first ultrasonic sensor 11 and the second ultrasonic sensor 12 is used, and thus ultrasonic waves enabling contactless detection are used, whereby the state of the backward belt surface 20*b* such as the remaining of the washing solution, the foreign matter, or the like can be easily and accurately detected.

The embodiments have been described above in detail with reference to the drawings, but the specific configurations are not limited to these embodiments, and change, replacement, omission, or the like may be made without departing from the scope of the present disclosure.

For example, in the example described above, the recording unit 13 of the recording device 1 is described to be of a serial type in which the head 13*a* moves while being mounted on the carriage 13*b*, but may be of a line type in which the head 13*a* is fixed and the carriage 13*b* is absent. In addition, the above-described example is given on the head 13*a* of an inkjet method, but the head may employ any recording method. A sublimation method, a transfer method, or an electrophotographic method may be employed.

Any component of the recording device 1 and the transport device 2 may be omitted. For example, as long as any of the first wiping unit 31 or the drying unit 33 can remove the washing solution remaining on the backward belt surface 20*b*, only one of these components may be provided, and the other one of these may be omitted.

Contents derived from the embodiments described above will be described below.

The recording device 1 includes the recording unit 13 configured to perform recording on the medium M, the transporting belt 20 configured to transport the medium M, the transporting belt 20 including a surface on which the medium M is able to be supported, the washing unit 30 configured to wash the surface of the transporting belt 20 using a liquid, the first ultrasonic sensor 11 configured to transmit an ultrasonic wave onto the surface of the transporting belt 20 and receive the ultrasonic wave reflected from the surface of the transporting belt 20, and the control unit 10 configured to determine a remaining state of the liquid on the surface of the transporting belt 20 based on a result of detection by the first ultrasonic sensor 11, in which the first ultrasonic sensor 11 transmits the ultrasonic wave onto at least part of the transporting belt 20, from downstream of the washing unit 30 to upstream of the recording unit 13, in a rotation direction of the transporting belt 20.

When the recording device 1 detects a distance to the surface of the transporting belt 20 by transmitting and receiving the ultrasonic waves to and from the surface of the transporting belt 20 using the first ultrasonic sensor 11, the distance from the surface of the transporting belt 20 to the first ultrasonic sensor 11 is shorter when the liquid used for the washing remains on the surface of the transporting belt 20 than when no liquid remains. Based on this, the control unit 10 can determine the remaining state of the liquid on the surface of the transporting belt 20. With the configuration described above, the recording device 1 can use the first ultrasonic sensor 11 to determine the remaining state of the liquid on the surface of the transporting belt 20 in a contactless manner. A user does not need to perform, on the first ultrasonic sensor 11 of the recording device 1, maintenance for a plurality of electrodes as with a sensor of a contact type. With the first ultrasonic sensor 11, an impact of the color of the washing solution on the detection accuracy can be suppressed from that with an optical sensor such as an infrared sensor.

The recording device 1 described above further includes the first wiping unit 31 that is provided downstream of the washing unit 30 and upstream of the recording unit 13 in the rotation direction, and is configured to wipe the surface of the transporting belt 20 by being in contact with the surface of the transporting belt 20, and the first adjustment unit 31*b* configured to adjust a load applied by the first wiping unit 31 onto the surface of the transporting belt 20, in which the first ultrasonic sensor 11 transmits the ultrasonic wave onto at least part of the transporting belt 20 from the downstream of the washing unit 30 to the upstream of the first wiping unit 31 in the rotation direction, and the control unit 10 adjusts the load by controlling the first adjustment unit 31*b* based on the result of the detection by the first ultrasonic sensor 11.

With the configuration described above, the control unit 10 of the recording device 1 increases the load imposed by the first wiping unit 31 when the amount of the liquid remaining on the surface of the transporting belt 20 is large, and decreases the load imposed by the first wiping unit 31 when the amount of the liquid remaining on the surface of the transporting belt 20 is small, for example. Thus, the recording device 1 can make the amount of the liquid remaining on the surface of the transporting belt 20 appropriate, while suppressing unnecessary wearing of the surface of the transporting belt 20 and of the first wiping unit 31.

The recording device 1 described above further includes the drying unit 33 that is provided downstream of the washing unit 30 and upstream of the recording unit 13 in the rotation direction, and configured to dry the surface of the transporting belt 20, and the notification unit 16 configured to perform notification of information, in which the first ultrasonic sensor 11 transmits the ultrasonic wave onto at least part of the transporting belt 20 from the downstream of the drying unit 33 to the upstream of the recording unit 13 in the rotation direction, and the control unit 10 controls the notification unit 16 to issue alert notification, upon determining that the liquid remains on the surface of the transporting belt 20 based on the result of the detection by the first ultrasonic sensor 11.

In the recording device 1, moisture such as a liquid remaining on the surface of the transporting belt 20 even after the passage through the drying unit 33 is likely to affect the printing quality. With the configuration described above, upon determining that the liquid remains on the surface of the transporting belt 20 based on the result of the detection by the first ultrasonic sensor 11, the control unit 10 controls the notification unit 16 to issue the alert notification. Thus, the user can easily recognize that the state of the surface affects the printing quality, whereby usability is improved.

The recording device 1 described above further includes the second ultrasonic sensor 12 configured to transmit another ultrasonic wave onto the surface of the transporting belt 20 and receive the other ultrasonic wave reflected from the surface of the transporting belt 20, in which the second ultrasonic sensor 12 transmits the other ultrasonic wave onto at least part of the transporting belt 20 from the downstream of the washing unit 30 to the upstream of the drying unit 33 in the rotation direction, and the control unit 10 determines whether a substance remaining on the surface of the transporting belt 20 is the liquid based on the result of the detection by the first ultrasonic sensor 11 and a result of detection by the second ultrasonic sensor 12.

With the configuration described above, in the recording device 1, the passage through the drying unit 33 in the state where the liquid remains on the surface of the transporting belt 20 results in a difference between the result of the detection by the first ultrasonic sensor 11 and the result of the detection by the second ultrasonic sensor 12 due to the liquid being dried off. In this case, the control unit 10 can determine or anticipate that the substance remaining on the surface of the transporting belt 20 is a liquid. In other words, when there is no difference between the result of the detection by the first ultrasonic sensor 11 and the result of the detection by the second ultrasonic sensor 12, the control unit 10 can determine or anticipate that the substance remaining on the surface of the transporting belt 20 is a substance other than a liquid such as fluff, for example.

The recording device 1 described above further includes the drying unit 33 that is provided downstream of the washing unit 30 and upstream of the recording unit 13 in the rotation direction, and configured to dry the surface of the transporting belt 20, in which the first ultrasonic sensor 11 transmits the ultrasonic wave onto at least part of the transporting belt 20 from the downstream of the washing unit 30 to the upstream of the drying unit 33 in the rotation direction, and the control unit 10 changes an output of the drying unit 33 by controlling the drying unit 33, based on the result of the detection by the first ultrasonic sensor 11.

With the above-described configuration, for example, the control unit 10 of the recording device 1 can favorably perform control such as increasing the output of the drying unit 33, such as one of the heater output and the air flow amount or both when the amount of the liquid remaining on the surface of the transporting belt 20 is large, and decreasing the output of the drying unit 33 when the amount of the liquid remaining on the surface of the transporting belt 20 is small. The recording device 1 is capable of achieving efficient drying and energy saving.

The recording device 1 described above further includes the second ultrasonic sensor 12 configured to transmit another ultrasonic wave onto the surface of the transporting belt 20 and receive the other ultrasonic wave reflected from the surface of the transporting belt 20, in which the second ultrasonic sensor 12 transmits the other ultrasonic wave onto at least part of the transporting belt 20 from the downstream of the drying unit 33 to the upstream of the recording unit 13 in the rotation direction, and the control unit 10 stops a recording operation by the recording unit 13 and a transport operation by the transporting belt 20, based on the result of the detection by the first ultrasonic sensor 11 and a result of detection by the second ultrasonic sensor 12.

With the above-described configuration, the control unit 10 of the recording device 1 can anticipate that water remains on the surface of the transporting belt 20 even after the passage through the drying unit 33 or that a substance other than water remains, when there is no difference between the result of the detection by the first ultrasonic sensor 11 and the result of the detection by the second ultrasonic sensor 12, even after changing the output of the drying unit 33. The control unit 10 can stop the recording operation by the recording unit 13 and the transport operation by the transporting belt 20, based on the result of the detection by the first ultrasonic sensor 11 and the result of the detection by the second ultrasonic sensor 12. Thus, the recording device 1 can prevent the printing quality from being compromised by water or a substance other than water on the surface of the transporting belt 20.

The transport device 2 includes the transporting belt 20 configured to transport the medium M, the pressing unit 34 configured to press the medium M onto a surface of the transporting belt 20, the washing unit 30 configured to wash the surface of the transporting belt 20 using a liquid, and the first ultrasonic sensor including the first transmission unit 11*a* configured to transmit an ultrasonic wave onto the surface of the transporting belt 20 and the first reception unit 11*b* configured to receive the ultrasonic wave reflected from the surface of the transporting belt 20, in which the first ultrasonic sensor 11 transmits the ultrasonic wave onto at least part of the transporting belt 20, from downstream of the washing unit 30 to upstream of the pressing unit 34, in a rotation direction of the transporting belt 20.

When the transport device 2 detects a distance to the surface of the transporting belt 20 by transmitting and receiving the ultrasonic waves to and from the surface of the transporting belt 20 using the first ultrasonic sensor 11, the distance from the surface of the transporting belt 20 to the first ultrasonic sensor 11 is shorter when the liquid used for the washing remains on the surface of the transporting belt 20 than when no liquid remains. Based on this, the control unit 10 can determine the remaining state of the liquid on the surface of the transporting belt 20. With the configuration described above, the transport device 2 can use the first ultrasonic sensor 11 to determine the remaining state of the liquid on the surface of the transporting belt 20 in a contactless manner. A user does not need to perform, on the first ultrasonic sensor 11 of the transport device 2, maintenance for a plurality of electrodes as with a sensor of a contact type. With the first ultrasonic sensor 11, an impact of the color of the washing solution on the detection accuracy can be suppressed from that with an optical sensor such as an infrared sensor.

What is claimed is:

1. A recording device comprising:

a recording unit configured to perform recording on a medium;

a transporting belt configured to transport the medium, the transporting belt including a surface configured to support the medium;

a washing unit configured to wash the surface using a liquid;

an ultrasonic sensor configured to transmit an ultrasonic wave onto the surface and receive the ultrasonic wave reflected from the surface; and a control unit configured to determine, based on a result of detection by the ultrasonic sensor, a remaining state of the liquid on the surface, wherein the ultrasonic sensor transmits the ultrasonic wave onto at least part of the transporting belt, the part being located from downstream of the washing unit to upstream of the recording unit in a rotation direction of the transporting belt.

2. The recording device according to claim 1, comprising:

a wiping unit provided downstream of the washing unit and upstream of the recording unit in the rotation direction, and configured to wipe the surface by coming into contact with the surface; and an adjustment unit configured to adjust a load applied by the wiping unit onto the surface, wherein the ultrasonic sensor transmits the ultrasonic wave onto at least part of the transporting belt, the part being located from the downstream of the washing unit to the upstream of the wiping unit in the rotation direction, and the control unit adjusts, based on the result of the detection by the ultrasonic sensor, the load by controlling the adjustment unit.

3. The recording device according to claim 1, comprising:

a drying unit provided downstream of the washing unit and upstream of the recording unit in the rotation direction, and configured to dry the surface; and a notification unit configured to perform notification of information, wherein the ultrasonic sensor transmits the ultrasonic wave onto at least part of the transporting belt, the part being located from the downstream of the drying unit to the upstream of the recording unit in the rotation direction, and the control unit controls the notification unit to issue alert notification upon determining, based on the result of the detection by the ultrasonic sensor, that the liquid remains on the surface.

4. The recording device according to claim 3, comprising another ultrasonic sensor configured to transmit another ultrasonic wave onto the surface and receive the other ultrasonic wave reflected from the surface, wherein the other ultrasonic sensor transmits the other ultrasonic wave onto at least part of the transporting belt, the part being located from the downstream of the washing unit to the upstream of the drying unit in the rotation direction, and the control unit determines, based on the result of the detection by the ultrasonic sensor and a result of detection by the other ultrasonic sensor, whether a substance remaining on the surface is the liquid.

5. The recording device according to claim 1, comprising a drying unit provided downstream of the washing unit and upstream of the recording unit in the rotation direction, and configured to dry the surface, wherein the ultrasonic sensor transmits the ultrasonic wave onto at least part of the transporting belt, the part being located from the downstream of the washing unit to the upstream of the drying unit in the rotation direction, and the control unit changes, based on the result of the detection by the ultrasonic sensor, an output of the drying unit by controlling the drying unit.

6. The recording device according to claim 5, comprising another ultrasonic sensor configured to transmit another ultrasonic wave onto the surface and receive the other ultrasonic wave reflected from the surface, wherein the other ultrasonic sensor transmits the other ultrasonic wave onto at least part of the transporting belt, the part being located from the downstream of the drying unit to the upstream of the recording unit in the rotation direction, and the control unit stops a recording operation performed by the recording unit and a transport operation performed by the transporting belt, based on the result of the detection by the ultrasonic sensor and a result of detection by the other ultrasonic sensor.

7. A transport device, comprising:

a transporting belt configured to transport a medium;

a pressing unit configured to press the medium onto a surface of the transporting belt;

a washing unit configured to wash the surface using a liquid; and an ultrasonic sensor including a transmission unit configured to transmit an ultrasonic wave onto the surface, and a reception unit configured to receive the ultrasonic wave reflected from the surface, wherein the ultrasonic sensor transmits the ultrasonic wave onto at least part of the transporting belt, the part being located from downstream of the washing unit to upstream of the pressing unit in a rotation direction of the transporting belt.

* * * * *